US011181027B2

(12) United States Patent
More et al.

(10) Patent No.: US 11,181,027 B2
(45) Date of Patent: Nov. 23, 2021

(54) AFTERTREATMENT SYSTEM INCLUDING NOISE REDUCING COMPONENTS

(71) Applicant: CUMMINS EMISSION SOLUTIONS INC., Columbus, IN (US)

(72) Inventors: Shashikant Ramdas More, Minneapolis, MN (US); Jacob D. Canik, Madison, WI (US); Jonathan M. Wuest, Janesville, WI (US); David A. Nickel, Oregon, WI (US); Jeffrey S. O'Neill, Elizabethtown, IN (US); Robney J. Andrews, Columbus, IN (US); Ken Hummel, Barneveld, WI (US); Shawn A. Rockey, Seymour, IN (US)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 17/042,578

(22) PCT Filed: Aug. 17, 2018

(86) PCT No.: PCT/US2018/000259
§ 371 (c)(1),
(2) Date: Sep. 28, 2020

(87) PCT Pub. No.: WO2019/194784
PCT Pub. Date: Oct. 10, 2019

(65) Prior Publication Data

US 2021/0017891 A1 Jan. 21, 2021

Related U.S. Application Data

(60) Provisional application No. 62/651,440, filed on Apr. 2, 2018.

(51) Int. Cl.
*F01N 3/00* (2006.01)
*F01N 3/20* (2006.01)
(Continued)

(52) U.S. Cl.
CPC ..... *F01N 3/2066* (2013.01); *F01N 3/2892* (2013.01); *F01N 13/18* (2013.01);
(Continued)

(58) Field of Classification Search
CPC ..... F01N 3/2892; F01N 2470/18; G10K 2210/32272
(Continued)

(56) References Cited

U.S. PATENT DOCUMENTS 4,111,778 A 9/1978 Davis et al.
4,534,213 A 8/1985 Mirikidani
(Continued)

FOREIGN PATENT DOCUMENTS

DE 10203310 A1 7/2003
DE 10348175 A1 5/2004
(Continued)

OTHER PUBLICATIONS

Elnady et al., "Investigation of the Acoustic Performance of After Treatment Devices," SAE Int. J. Passeng Cars—Sech Syst., vol. 4, Issue 2, pp. 1068-1075, published May 17, 2011.
(Continued)

*Primary Examiner* — Jason D Shanske
(74) *Attorney, Agent, or Firm* — Foley & Lardner LLP

(57) ABSTRACT

An apparatus includes a housing defining an internal volume and structured to house aftertreatment component for reducing constituents of an exhaust gas. A noise reducing com-
(Continued)

ponent is disposed within the internal volume and structured to extend around at least a portion of the aftertreatment component.

25 Claims, 27 Drawing Sheets

(51) Int. Cl.
*F01N 3/28* (2006.01)
*F01N 13/18* (2010.01)

(52) U.S. Cl.
CPC .... *F01N 2470/18* (2013.01); *F01N 2560/026* (2013.01); *F01N 2570/18* (2013.01); *F01N 2610/02* (2013.01)

(58) Field of Classification Search
USPC ..... 60/286
See application file for complete search history.

(56) References Cited

U.S. PATENT DOCUMENTS 4,851,015 A * 7/1989 Wagner ..... F01N 3/023 95/15
5,009,065 A 4/1991 Howe et al.
5,355,973 A 10/1994 Wagner et al.
5,403,557 A 4/1995 Harris
5,521,339 A 5/1996 Despain et al.
6,158,214 A 12/2000 Kempka et al.
6,220,021 B1 4/2001 Frederiksen et al.
6,651,773 B1 11/2003 Marocco
6,722,123 B2 4/2004 Liu et al.
6,732,509 B2 5/2004 Shiga
6,843,104 B2 1/2005 Busch
6,976,397 B2 12/2005 Widmer
7,104,358 B2 * 9/2006 Frederiksen ..... F01N 1/04 181/211
7,273,592 B2 * 9/2007 Jacob ..... F01N 1/24 181/212
7,415,901 B2 8/2008 Desrochers et al.
7,430,855 B2 10/2008 Amemiya et al.
7,665,797 B1 2/2010 Brosseau
8,079,211 B2 12/2011 Levin et al.
8,114,364 B2 2/2012 Harinath et al.
8,220,253 B2 7/2012 Werni et al.
8,240,137 B2 8/2012 Liu et al.
8,341,936 B2 1/2013 Zhang
8,371,109 B2 2/2013 Endo et al.
8,393,147 B2 3/2013 Gerges
8,528,319 B2 9/2013 Wilhelm et al.
8,580,003 B2 11/2013 Mitsuda
9,010,096 B2 4/2015 Golin et al.
9,103,252 B2 8/2015 Golin et al.
9,221,016 B2 12/2015 Van Niekerk et al.
9,556,781 B2 1/2017 Ludeman et al.
9,790,832 B2 10/2017 Mitsuda
10,493,410 B2 12/2019 Muruganantham et al.
2004/0040782 A1 * 3/2004 Frederiksen ..... F01N 13/0097 181/258
2004/0099475 A1 5/2004 Schulte
2007/0039316 A1 2/2007 Bosanec et al.
2007/0101703 A1 5/2007 Kanaya et al.
2007/0214862 A1 9/2007 Kubinski et al.
2008/0041043 A1 2/2008 Andersen
2009/0007551 A1 * 1/2009 Wahlstrom ..... F02B 37/00 60/299
2009/0145689 A1 6/2009 Han
2009/0266644 A1 10/2009 Price
2010/0064662 A1 3/2010 Hinz et al.
2010/0107614 A1 5/2010 Levin et al.
2010/0139258 A1 6/2010 Hackett et al.
2010/0196225 A1 8/2010 Harinath et al.
2010/0212292 A1 8/2010 Rusch et al.
2011/0030343 A1 2/2011 Kiser et al.
2011/0094206 A1 4/2011 Liu et al.
2011/0099978 A1 5/2011 Davidson et al.
2011/0107743 A1 5/2011 Ranganathan et al.
2011/0113759 A1 5/2011 Tilinski et al.
2011/0131958 A1 6/2011 Adelman et al.
2011/0146253 A1 6/2011 Isada et al.
2011/0146254 A1 6/2011 Yi et al.
2011/0167805 A1 7/2011 Chen
2011/0180347 A1 7/2011 Butler
2012/0090305 A1 4/2012 Floyd et al.
2012/0102920 A1 5/2012 Pipis, Jr.
2012/0174561 A1 7/2012 Troxler et al.
2012/0324872 A1 12/2012 Jaruvatee et al.
2013/0031891 A1 2/2013 Ponnathpur
2013/0061577 A1 3/2013 Floyd et al.
2013/0340417 A1 12/2013 Morey et al.
2015/0101318 A1 4/2015 Munnannur et al.
2015/0233276 A1 8/2015 Cassity et al.
2016/0006111 A1 1/2016 Miskovsk et al.
2016/0084133 A1 3/2016 Sampath et al.
2016/0215673 A1 7/2016 Noren et al.
2017/0074133 A1 * 3/2017 Reichelt ..... F01N 13/04
2017/0361273 A1 12/2017 Zoran et al.
2017/0370262 A1 12/2017 Zoran et al.

FOREIGN PATENT DOCUMENTS

DE 10 2008 018 063 A1 11/2008
DE 10 2009 036 511 A1 2/2011
EP 0 556 846 A1 8/1996
EP 0 931 913 A1 7/1999
EP 0 978 721 A1 2/2000
EP 1 748 162 A1 1/2007
GB 2 448 993 B 11/2008
WO WO-2011/126930 A2 10/2011
WO WO-2011/163395 A1 12/2011
WO WO-2013/025860 A1 2/2013

OTHER PUBLICATIONS

Howard, et al., "Adaptive-Passive Quarter-Wave Tube Resonator Silencer," Proceedings of ACOUSTICS 2011, Nov. 2-4, 2011, Gold Coast, Australia, 7 pages.
International Search Report and Written opinion issued for PCT/US2018/00259, dated Dec. 6, 2018, 17 pages.
Dwyer, "Air Velocity Measurement," retrieved from https://www.dwyer-inst.com/products/airvelocityintroduction.cfm, 6 pages (2010).
Extended European Search Report for European Patent App. No. 13154457.9 dated May 7, 2013, 7 pages.
International Search Report & Written Opinion for PCT/US2015/010837, dated May 6, 2015, 9 pages.
International Search Report & Written Opinion for PCT/US2018/040737, dated Sep. 7, 2018, 9 pages.

* cited by examiner

FIG. 2A
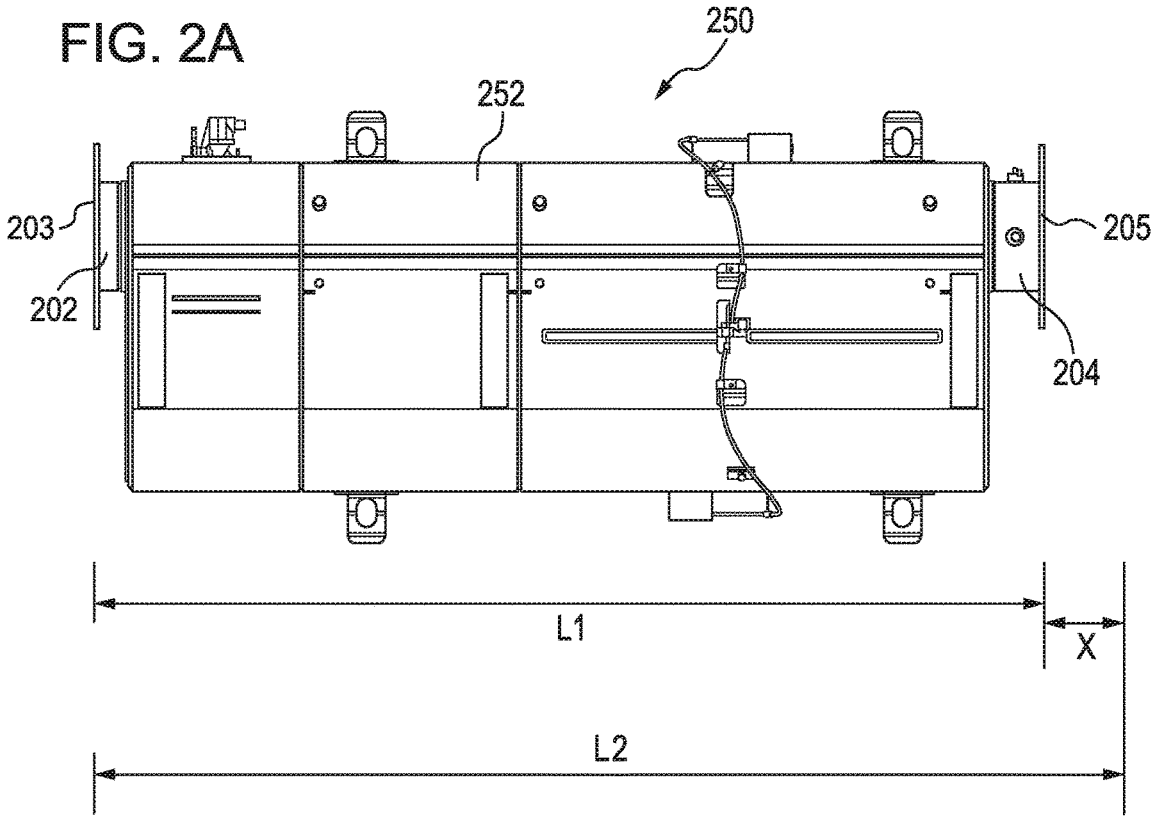
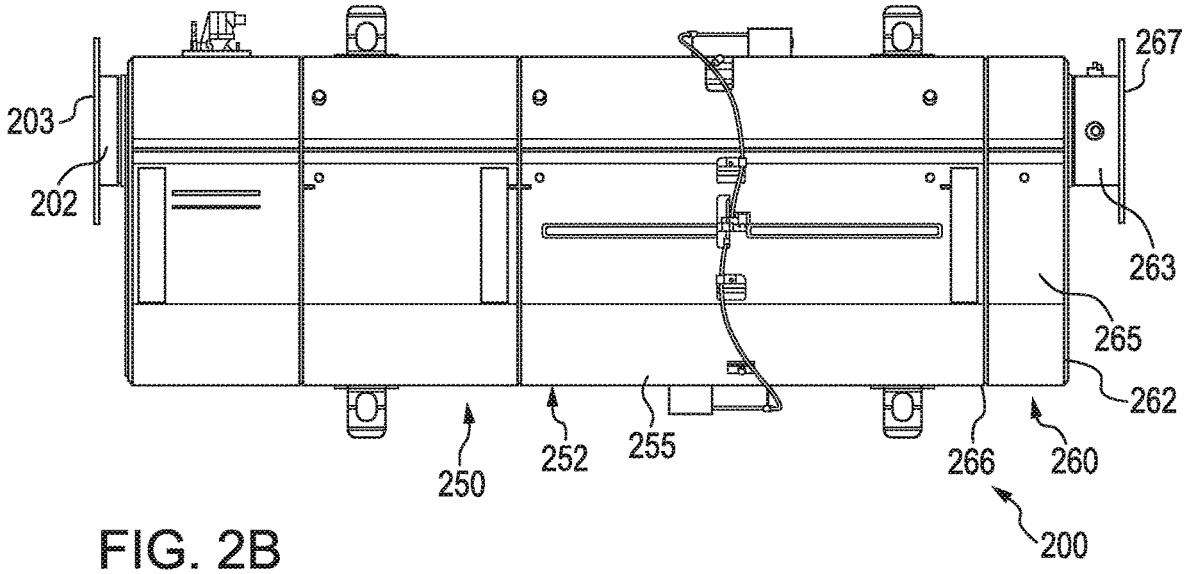
FIG. 2B

AFTERTREATMENT SYSTEM INCLUDING NOISE REDUCING COMPONENTS

CROSS REFERENCE TO RELATED APPLICATIONS

The present application is a national stage of PCT Application No. PCT/US2018/000259, filed Aug. 17, 2018, which claims priority to and benefit of U.S. Provisional Patent Application No. 62/651,440, filed Apr. 2, 2018. The contents of these applications are incorporated herein by reference in their entireties and for all purposes.

TECHNICAL FIELD

The present disclosure relates generally to aftertreatment systems for use with internal combustion (IC) engines.

BACKGROUND

Exhaust aftertreatment systems are used to receive and treat exhaust gas generated by IC engines. Generally exhaust gas aftertreatment systems comprise any of several different components to reduce the levels of harmful exhaust emissions present in exhaust gas. For example, certain exhaust gas aftertreatment systems for diesel-powered IC engines comprise a selective catalytic reduction (SCR) system, including a catalyst formulated to convert NOx (NO and $NO_2$ in some fraction) into harmless nitrogen gas ($N_2$) and water vapor ($H_2O$) in the presence of ammonia ($NH_3$). Generally in such aftertreatment systems, an exhaust reductant (e.g., a diesel exhaust fluid such as urea) is injected into the SCR system to provide a source of ammonia and mixed with the exhaust gas to partially reduce the NOx gases. The reduction byproducts of the exhaust gas are then fluidly communicated to the catalyst included in the SCR system to decompose substantially all of the NOx gases into relatively harmless byproducts that are expelled out of the aftertreatment system.

Noise reduction components, such as a muffler or noise attenuation modules, are generally provided downstream of an aftertreatment system, which increases the length of the aftertreatment system. Mounting locations and or support structures generally have to be shaped and sized to accommodate such noise reduction components, which may increase design complexity and manufacturing cost.

SUMMARY

Embodiments described herein relate generally to aftertreatment systems including noise reducing components provided within a housing of the aftertreatment system, the noise reducing components being extended around, and/or positioned upstream and/or downstream of the aftertreatment component. In some embodiments, an apparatus comprises a housing defining an internal volume structured to house an aftertreatment component configured to reduce constituents of an exhaust gas. A noise reducing component is disposed within the internal volume and structured to extend around an outer periphery of at least a portion of the aftertreatment component.

In some embodiments, an aftertreatment system for reducing constituents of an exhaust gas produced by an engine comprises a housing defining an internal volume. An aftertreatment component is positioned within the internal volume. A noise reducing component is positioned within the internal volume and extends around an outer periphery of at least a portion of the aftertreatment component.

In some embodiments, an aftertreatment system for decomposing constituents of an exhaust gas produced by an engine comprises an aftertreatment module and a noise reduction module. The aftertreatment module comprises an aftertreatment module housing comprising an inlet for receiving the exhaust gas. An aftertreatment module housing outer surface extends around a longitudinal axis of the aftertreatment system. An aftertreatment component is positioned within the aftertreatment module housing. A noise reduction module is located at an end of the aftertreatment module and coupled to the aftertreatment module, the noise reduction module being configured to receive treated exhaust gas from the aftertreatment module. The noise reduction module comprises a noise reduction module housing comprising an outlet for expelling treated exhaust gas. A noise reduction module housing outer wall extends around the longitudinal axis of the aftertreatment system. A noise reduction component is disposed within the noise reduction module housing. An outermost extent of the noise reduction module housing outer surface in a direction perpendicular to the longitudinal axis of the aftertreatment system is at or inward of an innermost extent of the aftertreatment module housing outer surface in the direction perpendicular to the longitudinal axis.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

The foregoing and other features of the present disclosure will become more fully apparent from the following description and appended claims taken in conjunction with the accompanying drawings. Understanding that these drawings depict only several implementations in accordance with the disclosure and are therefore not to be considered limiting of its scope, the disclosure will be described with additional specificity and detail through use of the accompanying drawings.

FIG. 2A is a side view of an embodiment of an aftertreatment module, and FIG. 2B is a side view of an embodiment of an aftertreatment system including the aftertreatment module of FIG. 2A and a noise reduction module fluidly coupled to the aftertreatment module of FIG. 2A.

Figure 1:
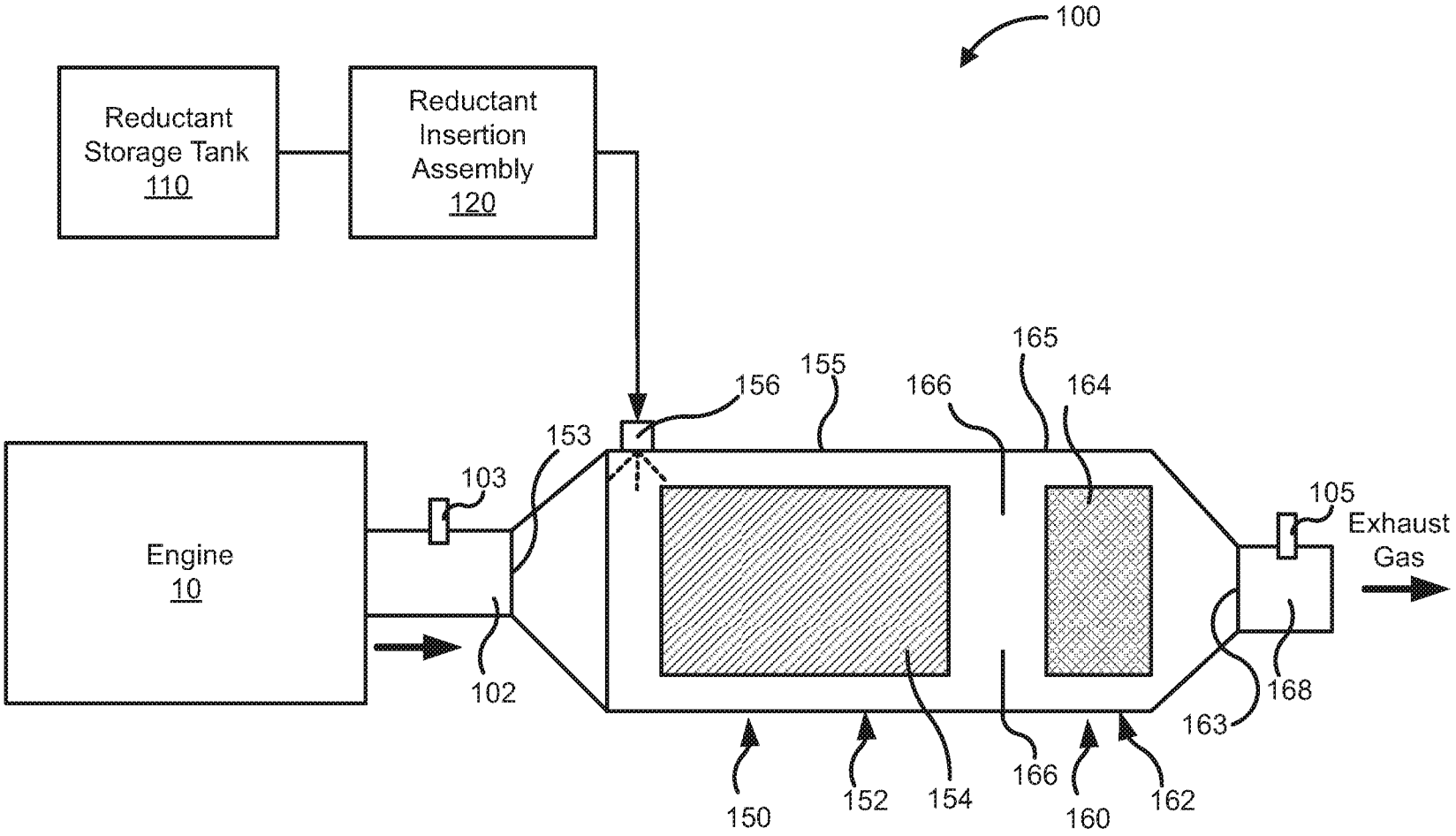
FIG. 1 is a schematic illustration of an embodiment of an aftertreatment system.

Reference is made to the accompanying drawings throughout the following detailed description. In the drawings, similar symbols typically identify similar components unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein and illustrated in the figures, can be arranged, substituted, combined, and designed in a wide variety of different configurations, all of which are explicitly contemplated and made part of this disclosure.

DETAILED DESCRIPTION

Embodiments described herein relate generally to aftertreatment systems including noise reducing components provided within a housing of the aftertreatment system, the noise reducing components being extended around, and/or positioned upstream and/or downstream of the aftertreatment component.

Noise reduction components such as a muffler or silencers are generally provided downstream of an aftertreatment system. For example, third party noise reduction components (e.g., silencers, mufflers) are often coupled to aftertreatment systems for providing noise attenuation. Such noise reduction components or systems may have any shape, and mounting locations and/or support structures generally have to be shaped and sized to accommodate such noise reduction feature. This increases the space occupied by such aftertreatment systems, design complexity and manufacturing cost. Furthermore, portions of the noise reduction components and/or the aftertreatment system may extend outwards from a bulk of such components which adds to space occupied by such aftertreatment systems.

Various embodiments of the systems and methods for providing a noise reduction module in aftertreatment system may provide benefits including, for example: (1) providing noise reduction features integrated within aftertreatment systems; (2) avoiding a significant increase in the overall dimensions or volume of the aftertreatment system, as well as maintaining an overall shape of the aftertreatment system; (3) reducing the need to make changes to customer interfaces (e.g., mounting location, mounting hardware, clearances, etc.) on which the aftertreatment system is mounted; (4) having little to no impact on aftertreatment performance; (5) allowing usage with a wide variety of aftertreatment systems; and (6) providing space claim advantage by obviating the use of a downstream noise reducing component.

FIG. 1 is a schematic illustration of an aftertreatment system 100, according to an embodiment. The aftertreatment system 100 is configured to receive an exhaust gas (e.g., a diesel exhaust gas) from an engine 10 (e.g., a diesel engine, a dual fuel engine, etc.) and reduce constituents of the exhaust gas such as, for example, NOx gases, CO, hydrocarbons, etc. The aftertreatment system 100 may comprise a reductant storage tank 110, a reductant insertion assembly 120, an aftertreatment module 150 and a noise reduction module 160.

The reductant storage tank 110 is structured to store a reductant. The reductant is formulated to facilitate decomposition of the constituents of the exhaust gas (e.g., NOx gases included in the exhaust gas). Any suitable reductant can be used. In some embodiments, the exhaust gas comprises a diesel exhaust gas and the reductant comprises a diesel exhaust fluid. For example, the diesel exhaust fluid may comprise urea, an aqueous solution of urea, or any other fluid that comprises ammonia, by-products, or any other diesel exhaust fluid as is known in the art (e.g., the diesel exhaust fluid marketed under the name ADBLUE®). For example, the reductant may comprise an aqueous urea solution having a particular ratio of urea to water. In particular embodiments, the reductant can comprise an aqueous urea solution including 32.5 w/w % of urea and 67.5 w/w % of deionized water, or including 40 w/w % of urea and 60 w/w % of deionized water, or any other suitable ratio of urea to deionized water.

A reductant insertion assembly 120 is fluidly coupled to the reductant storage tank 110 and configured to receive the reductant therefrom. In some embodiments, the reductant insertion assembly 120 may be configured to selectively insert the reductant in an inlet conduit 102 coupled to an inlet 153 of the aftertreatment module 150. In other embodiments, the reductant insertion assembly 120 may be configured to insert the reductant directly into an aftertreatment component 154 included in the aftertreatment module 150. The reductant insertion assembly 120 may comprise various structures to facilitate receiving the reductant from the reductant storage tank 110, and delivery to the aftertreatment module 150.

For example, the reductant insertion assembly 120 may comprise one or more pumps having filter screens (e.g., to prevent solid particles of the reductant or contaminants from flowing into the pump) and/or valves (e.g., check valves) positioned upstream thereof to receive reductant from the reductant storage tank 110. In some embodiments, the pump may comprise a diaphragm pump, but any other suitable pump may be used such as, for example, a centrifugal pump, a suction pump, a positive displacement pump, etc.

The pump may be configured to pressurize the reductant so as to provide the reductant to the aftertreatment module 150 at a predetermined pressure. Screens, check valves, pulsation dampers, or other structures may also be positioned downstream of the pump to provide the reductant to the aftertreatment module 150. In various embodiments, the reductant insertion assembly 120 may also comprise a bypass line structured to provide a return path of the reductant from the pump to the reductant storage tank 110.

A valve (e.g., an orifice valve) may be provided in the bypass line. The valve may be structured to allow the reductant to pass therethrough to the reductant storage tank 110 if an operating pressure of the reductant generated by the pump exceeds a predetermined pressure so as to prevent over pressurizing of the pump, the reductant delivery tubes, or other components of the reductant insertion assembly 120. In some embodiments, the bypass line may be configured to allow the return of the reductant to the reductant storage tank 110 during purging of the reductant insertion assembly 120 (e.g., after the aftertreatment system 100 is shut off).

In various embodiments, the reductant insertion assembly 120 may also comprise a blending chamber structured to receive pressurized reductant from a metering valve at a controllable rate. The blending chamber may also be structured to receive air, or any other inert gas (e.g., nitrogen), for example from an air supply unit so as to deliver a combined flow of the air and the reductant to the aftertreatment module 150 through a reductant insertion port 156 provided in the aftertreatment module 150. In various embodiments, a nozzle may be positioned in the reductant insertion port 156 and structured to deliver a stream or a jet of the reductant into the aftertreatment module 150.

In various embodiments, the reductant insertion assembly 120 may also comprise a dosing valve, for example positioned within a reductant delivery tube for delivering the reductant from the reductant insertion assembly 120 to the aftertreatment module 150. The dosing valve may comprise any suitable valve, for example, a butterfly valve, a gate valve, a check valve (e.g., a tilting disc check valve, a swing check valve, an axial check valve, etc.), a ball valve, a spring loaded valve, an air assisted injector, a solenoid valve, or any other suitable valve. The dosing valve may be selectively opened to insert a predetermined quantity of the reductant for a predetermined time into the aftertreatment module 150 or upstream therefrom. Opening and/or closing of the dosing valve may produce an audible sound (e.g., a clicking sound).

The aftertreatment module 150 comprises an aftertreatment module housing 152 within which an aftertreatment component 154 is positioned. The aftertreatment module housing 152 includes an aftertreatment module housing outer surface 155 extending around a longitudinal axis of the aftertreatment system 100. The aftertreatment module housing 152 may be formed from a rigid, heat-resistant and corrosion-resistant material, for example stainless steel, iron, aluminum, metals, ceramics, or any other suitable material. The aftertreatment module housing 152 may have any suitable cross-section, for example circular, square, rectangular, oval, elliptical, polygonal, or any other suitable shape. The aftertreatment module housing 152 comprises an inlet 153 structured to receive the exhaust gas.

In some embodiments, the aftertreatment component 154 may comprise an SCR catalyst configured to decompose constituents of the exhaust gas (e.g., NOx gases included in the exhaust gas). In particular embodiment, the SCR catalyst may comprise a selective catalytic reduction filter (SCRF) system, or any other aftertreatment component, configured to decompose constituents of the exhaust gas (e.g., NOx gases such as such nitrous oxide, nitric oxide, nitrogen dioxide, etc.), flowing through the aftertreatment system 100 in the presence of a reductant, as described herein.

Although FIG. 1 shows only one aftertreatment component 154 positioned within the aftertreatment housing internal volume, in other embodiments, a plurality of aftertreatment components may be positioned within the aftertreatment module housing 152 in addition to or in place of the aftertreatment component 154 (e.g., an SCR catalyst). Such aftertreatment components may comprise, for example, filters (e.g., particulate matter filters, catalyzed filters, etc.), oxidation catalysts (e.g., carbon monoxide, hydrocarbons and/or ammonia oxidation catalysts), mixers, baffle plates, or any other suitable aftertreatment component.

In particular embodiments, the aftertreatment component 154 may include an SCR catalyst formulated to selectively decompose constituents of the exhaust gas. Any suitable SCR catalyst can be used such as, for example, platinum, palladium, rhodium, cerium, iron, manganese, copper, vanadium based catalyst, any other suitable catalyst, or a combination thereof. The SCR catalyst may be disposed on a suitable substrate such as, for example, a ceramic (e.g., cordierite) or metallic (e.g., kanthal) monolith core which can, for example, define a honeycomb structure. A washcoat can also be used as a carrier material for the SR catalyst. Such washcoat materials may comprise, for example, aluminum oxide, titanium dioxide, silicon dioxide, any other suitable washcoat material, or a combination thereof. The exhaust gas (e.g., diesel exhaust gas) can flow over and/or about the SCR catalyst such that any NOx gases included in the exhaust gas are further reduced to yield an exhaust gas which is substantially free of NOx gases.

The reductant insertion port 156 may be provided on a sidewall of aftertreatment module housing 152 and structured to allow insertion of a reductant therethrough into the aftertreatment housing internal. The reductant insertion port 156 may be positioned upstream of the aftertreatment component 154 (e.g., an SCR catalyst to allow reductant to be inserted into the exhaust gas upstream of the SCR catalyst) or over the aftertreatment component 154 (e.g., over the SCR catalyst to allow reductant to be inserted directly on the SCR catalyst). In other embodiments, the reductant insertion port 156 may be disposed on the inlet conduit 102 and configured to insert the reductant into the inlet conduit 102 upstream of the aftertreatment component 154. In such embodiments, mixers, baffles, vanes or other structures may be positioned in an inlet conduit 102 so as to facilitate mixing of the reductant with the exhaust gas.

The inlet conduit 102 is fluidly coupled to the inlet 153 of the aftertreatment module housing 152 and structured to receive exhaust gas from the engine 10 so as to communicate the exhaust gas to the aftertreatment module housing 152. A first sensor 103 may be positioned in the inlet conduit 102. The first sensor 103 may comprise a NOx sensor, for example a physical or virtual NOx sensor, configured to determine an amount of NOx gases included in the exhaust gas being emitted by the engine 10. In various embodiments, an oxygen sensor, a temperature sensor, a pressure sensor, or any other sensor may also be positioned in the inlet conduit 102 so as to determine one or more operational parameters of the exhaust gas flowing through the aftertreatment system 100

The noise reduction module 160 is located at an end of the aftertreatment module 150 and coupled to the aftertreatment module 150. The noise reduction module 160 is distinct from the aftertreatment module 150. In other words, the noise reduction module 160 is a separate component from the aftertreatment module 150, and is coupled to the end thereof so as to form the aftertreatment system 100. The noise reduction module 160 is configured to receive treated exhaust gas from the aftertreatment module 150. For example, as shown in FIG. 1, the noise reduction module 160 is positioned downstream of the aftertreatment module 150 and coupled to the aftertreatment module 150 at an axial end thereof. The noise reduction module 160 comprises a noise reduction module housing 162 comprising an outlet 163 for expelling treated exhaust gas (e.g., substantially removed of NOx gases) out of the aftertreatment system 100 into the atmosphere. A noise reduction component 164 may be positioned within the noise reduction module housing 162. The noise reduction component 164 may include but is not limited to Helmholtz resonators, quarter wave tubes, perforated tubes, baffles, expansion plates, acoustic cavities, acoustic noise absorption materials or a combination thereof.

An outlet conduit 168 may be coupled to the outlet 163 (e.g., via a coupling flange). A second sensor 105 may be positioned in the outlet conduit 168. The second sensor 105 may comprise a second NOx sensor configured to determine an amount of NOx gases expelled into the environment after passing through the aftertreatment component 154. In other embodiments, the second sensor 105 may comprise an ammonia oxide (AMOx) sensor configured to determine an amount of ammonia in the exhaust gas downstream of the aftertreatment component 154 so as to determine an ammonia slip of the aftertreatment component 154 (e.g., an SCR catalyst). The ammonia slip may be used to adjust an amount of reductant to be inserted into the aftertreatment component 154 by the reductant insertion assembly 120.

The noise reduction module housing 162 may be formed from a rigid, heat-resistant and corrosion-resistant material, for example stainless steel, iron, aluminum, metals, ceramics, or any other suitable material. The noise reduction module housing 162 may have any suitable cross-section, for example circular, square, rectangular, oval, elliptical, polygonal, or any other suitable shape. In various embodiments, the noise reduction module housing 162 may be formed from the same material as the aftertreatment module housing 152, and/or have the same shape as the aftertreatment module housing 152.

The noise reduction module housing 162 includes a noise reduction module housing outer surface 165 extending around the longitudinal axis of the aftertreatment system 100. An outermost extent of the noise reduction module housing outer surface 165 in a direction perpendicular to the longitudinal axis of the aftertreatment system may be located at or inward of the innermost extend of the aftertreatment module housing outer surface 155 in the direction perpendicular to the longitudinal axis of the aftertreatment system 100.

For example, a bulk of the aftertreatment module housing 152 may have an outer diameter or cross-section measured in a plane perpendicular to the longitudinal axis, and a bulk of the noise reduction module housing 162 may have an outer diameter or cross-section in the same plane which is less than or equal to the outer diameter or cross-section of the bulk of the aftertreatment module housing 152 such that the noise reduction module housing outer surface 165 is continuous with the aftertreatment module housing outer surface 155. This may allow a bulk of the aftertreatment system 100 located between the inlet and outlet to have the same cross-section such that no portion of an interface 166 between the noise reduction module housing 162 and the aftertreatment module housing 152 extends beyond the cross-section. This avoids any portion of the aftertreatment module housing 152 and the noise reduction module housing 162 from extending outwards in the direction perpendicular to the longitudinal axis from their respective outer surfaces 155 and 165, which would not be the case if the noise reduction module housing 162 and the aftertreatment module housing 152 were coupled using couplers such as flanges. This provides additional space saving, as well avoids modifications to mounting structures or interfaces to accommodate such couplers.

As previously described, the noise reduction module housing outer surface 165 may be coupled to the aftertreatment module housing outer surface 155 at the interface 166 such that the noise reduction module housing outer surface 165 is continuous with the aftertreatment module housing outer surface 155 in a longitudinal direction of the aftertreatment system 100. In other words, the noise reduction module 160 is continuous with the aftertreatment module 150. In some embodiments, the noise reduction module housing outer surface 165 may be fixedly coupled to the aftertreatment module housing outer surface 155, for example, welded or fusion bonded thereto. In other embodiments, the noise reduction module housing outer surface 165 may be removably coupled to the aftertreatment module housing outer surface 155, for example, via screws, bolts, nuts, rivets, etc. Furthermore, a cross-sectional shape of the noise reduction module housing 162 in a plane perpendicular to the longitudinal axis of the aftertreatment system 100 may be substantially the same as a cross-sectional shape of the aftertreatment module housing 152 in a plane perpendicular to the longitudinal axis of the aftertreatment system 100.

As previously described herein, the noise reduction module housing 162 does not extend radially outwards from the aftertreatment module housing 152. For example, the aftertreatment module housing 152 may define a first cross-section (e.g., diameter) and the noise reduction module housing 162 may define a second cross-section (e.g., diameter) which is substantially equal to the first cross-section. In other embodiments, the noise reduction module housing 162 may be positioned radially inwards from the aftertreatment module housing 152. For example, the second cross-section of the noise reduction module housing 162 may be smaller than the first cross-section of the aftertreatment module housing 152.

In particular embodiments, an increase in an axial length of the aftertreatment system 100 due to coupling of the noise reduction module 160 to the aftertreatment module 150 is less than 150 mm. In this manner, the noise reduction module 160 may add minimally to the overall dimensions of the aftertreatment system 100, which may facilitate mounting of the aftertreatment system 100 on mounting structures (e.g., a mounting interface of a vehicle including the engine 10) without requiring any modifications or changes to the mounting structures. In other embodiments, coupling of the noise reduction module 160 to the aftertreatment module 150 may not result in an increase in the overall length of the aftertreatment system 100, for example, due to a corresponding decrease in a length of the aftertreatment module 150.

In some embodiments, the inlet 153 of the aftertreatment module housing 152 and the outlet 163 of the noise reduction module housing 162 may be oriented parallel to the longitudinal axis of the aftertreatment system 100. For example, the inlet 153 may be axially aligned with the outlet 163 in the longitudinal direction of the aftertreatment system 100. In other embodiments, the inlet 153 may be oriented parallel to the longitudinal axis and the outlet 163 may be oriented perpendicular to the longitudinal axis, or vice versa. In still other embodiments, both the inlet 153 and the outlet 163 may be oriented perpendicular to the longitudinal axis of the aftertreatment system 100.

FIG. 2A is a side-view of an aftertreatment module 250 that may be included in an aftertreatment system (e.g., the aftertreatment system 100). The aftertreatment module 250 comprises an aftertreatment module housing 252 comprising an inlet 202 having an inlet flange 203 coupled thereto. The inlet flange 203 may be configured to be coupled to an inlet conduit (e.g., the inlet conduit 102) configured to communicate exhaust gas from an engine (e.g., the engine 10) to the aftertreatment module 250. The aftertreatment module 250 also includes an outlet 204 having an outlet flange 205 coupled thereto, for example, to allow coupling of the outlet 204 to an outlet conduit (e.g., the outlet conduit 168). FIG. 2A shows the aftertreatment module housing 252 being generally rectangular having a pair of semi-circular radial sidewalls, and having a first axial length L1. In other embodiments, the aftertreatment module 250 may have any other shape or size. One or more aftertreatment components (e.g., the aftertreatment component 154) may be positioned within an internal volume defined by the aftertreatment module housing 152.

FIG. 2B is a side-view of an aftertreatment system 200 that includes the aftertreatment module 250 and a noise reduction module 260, according to an embodiment. The noise reduction module 260 is distinct from the aftertreatment module 250, as previously described herein. The noise reduction module 260 is located at a downstream end of the aftertreatment module 250 and coupled to the aftertreatment module 250. The noise reduction module 260 is configured to receive treated exhaust gas from the aftertreatment module 250. The noise reduction module 260 comprises a noise reduction module housing 262 within which one or more noise reduction components (e.g., the noise reduction component 164) may be positioned. Instead of the aftertreatment module housing 252 having the outlet 204, the noise reduction module housing 262 comprises an outlet 263 having an outlet flange 267 attached thereto configured to fluidly couple the outlet 263 to an outlet conduit (e.g., the outlet conduit 168).

A noise reduction module housing outer surface 265 of the noise reduction module housing 262 is coupled to an aftertreatment module housing outer surface 255 of the aftertreatment module housing 252 at an interface 266 (e.g., a welded joint) such that the noise reduction module housing 262 is continuous with the aftertreatment module housing 252. Furthermore, an outermost extent of the noise reduction module housing outer surface 265 in a plane perpendicular to a longitudinal axis of the aftertreatment system 200 is located at an innermost extent of the aftertreatment module housing outer surface 255 in the same direction. For example, as shown in FIG. 2B, noise reduction module housing 262 may have substantially the same cross-section in the direction perpendicular to the longitudinal axis, and may also have the same cross-sectional shape as the aftertreatment module housing 252.

A second axial length L2 of the aftertreatment system 200 after coupling the noise reduction module 260 to the aftertreatment module 250 is longer than the first axial length L1 of the aftertreatment module 250 without the noise reduction module 260 coupled thereto. In various embodiments, a difference X between the second axial length L2 and the first axial length L1 may be less than 150 mm. In other words, coupling the noise reduction module 260 to the aftertreatment module 250 as described herein may only add less than 150 mm to the first axial length L1 of the aftertreatment module 250. In other embodiments, the noise reduction module 260 may be integrated with the aftertreatment module 250 such that there is no substantial increase in a the length of the aftertreatment system 200.

Figure 3:
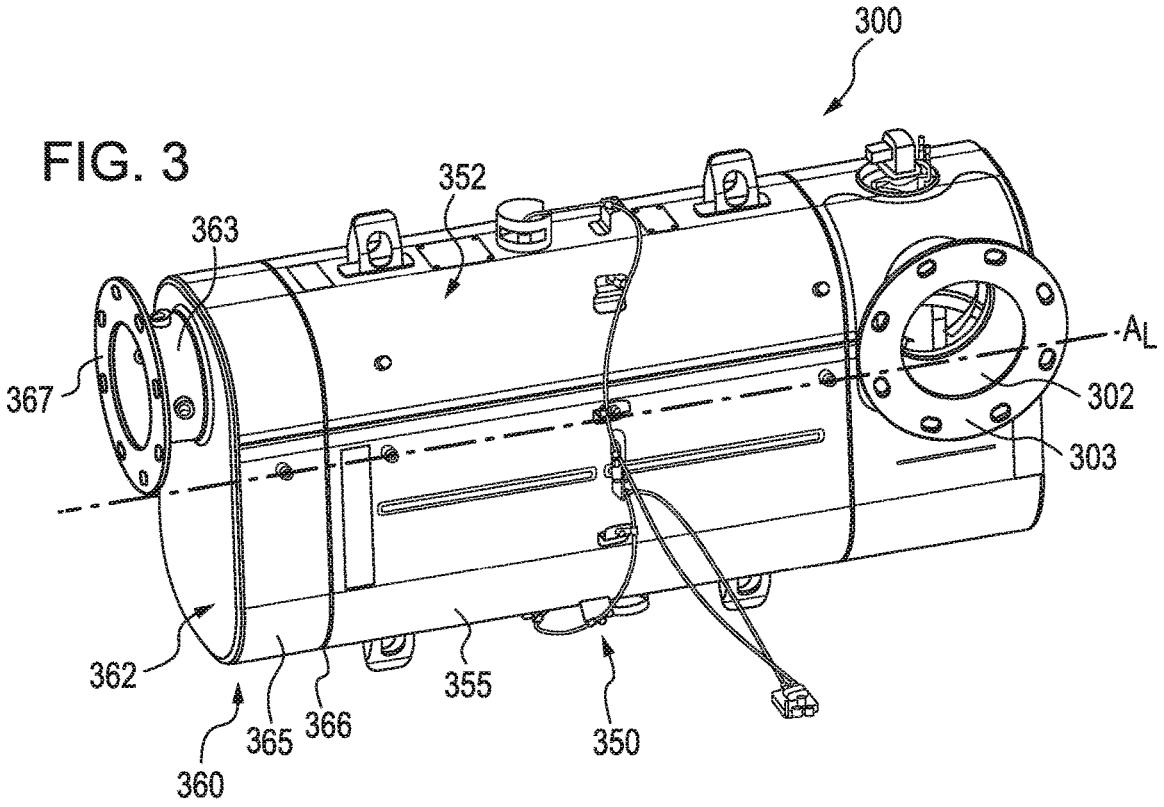
FIG. 3 is a perspective view of an aftertreatment system, according to a particular embodiment.

FIG. 3 is a perspective view of an aftertreatment system 300, according to an embodiment. The aftertreatment system 300 includes an aftertreatment module 350 and a noise reduction module 360 located at a downstream end of the aftertreatment module 350 and fluidly coupled to the aftertreatment module 350. The noise reduction module 360 is distinct from the aftertreatment module 350. The aftertreatment module 350 includes an aftertreatment module housing 352 comprising an inlet 302 having an inlet flange 303 coupled thereto. The inlet 302 is oriented perpendicular to a longitudinal axis $A_L$ of the aftertreatment system 100. One or more aftertreatment components (e.g., the aftertreatment component 154) may be positioned within the aftertreatment module housing 352.

The noise reduction module 360 comprises a noise reduction module housing 362 within which one or more noise reduction components (e.g., the noise reduction component 164) may be positioned. The noise reduction module housing 362 comprises an outlet 363 having an outlet flange 367 attached thereto configured to fluidly couple the outlet 363 to an outlet conduit (e.g., the outlet conduit 168). The inlet flange 303 and the outlet flange 367 may comprise a socket weld flange, a thread flange, a slip-on flange or a lap joint flange.

Furthermore, the outlet 363 is oriented parallel to the longitudinal axis $A_L$ of the aftertreatment system 300. A noise reduction module housing outer surface 365 of the noise reduction module housing 362 is coupled to an aftertreatment module housing outer surface 355 of the aftertreatment module housing 352 at an interface 366 (e.g., a welded joint) such that an outermost extent of the noise reduction module housing outer surface 365 in a direction perpendicular to the longitudinal axis $A_L$ is at an innermost extent of the aftertreatment module housing outer surface 355 in the same direction. Furthermore, a cross-sectional shape of the noise reduction module housing 362 in a plane perpendicular to the longitudinal axis $A_L$ of the aftertreatment system is substantially the same as a cross-sectional shape of the aftertreatment module housing 352 in the same plane.

Figure 4:
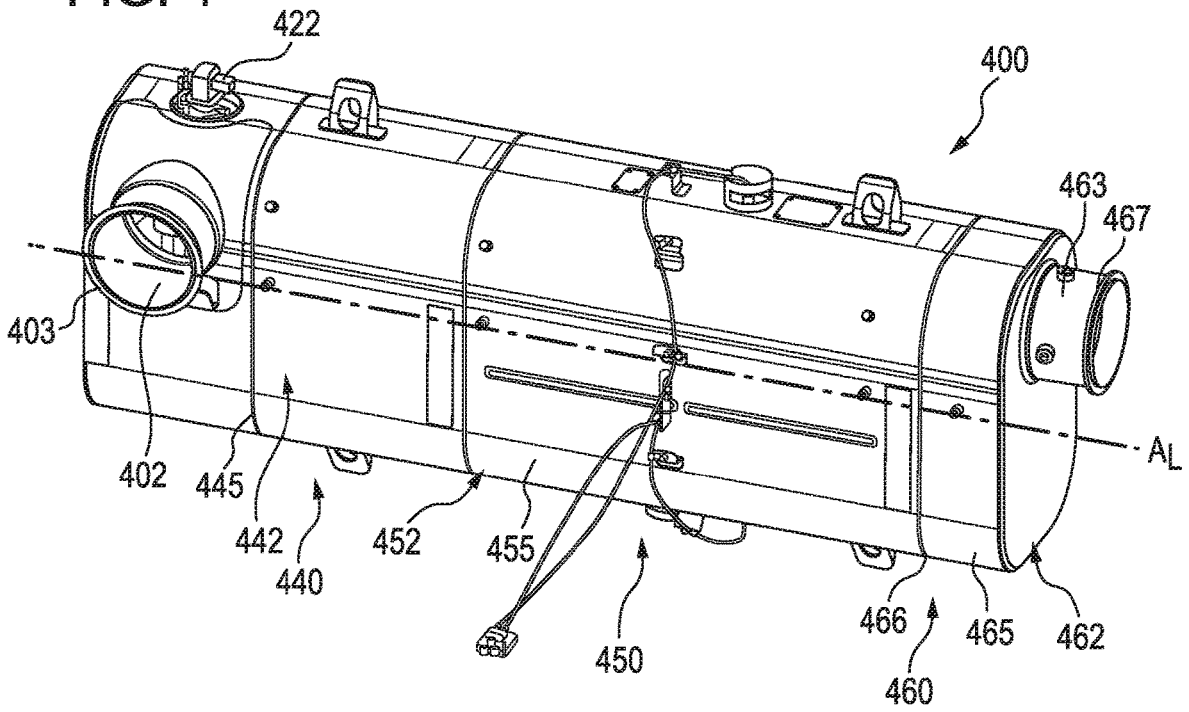
FIG. 4 is a perspective view of an aftertreatment system, according to another embodiment.

FIG. 4 is a perspective view of an aftertreatment system 400, according to another embodiment. The aftertreatment system 400 includes an aftertreatment module 450 and a noise reduction module 460 located downstream of the aftertreatment module 350 and fluidly coupled to the aftertreatment module 450. The noise reduction module 460 is distinct from the aftertreatment module 450, as previously described herein. Furthermore, a mixer module 440 is positioned upstream of the aftertreatment module 450 and coupled thereto. The mixer module 440 comprises a mixer module housing 442 comprising an inlet 402 having an inlet flange 403 coupled thereto. The inlet 402 is oriented perpendicular to a longitudinal axis $A_L$ of the aftertreatment system 400. A reductant injector 422 is positioned proximate to the inlet 402 and configured to insert a reductant into the aftertreatment system 400 upstream of the mixer module 440. One or more mixing components (e.g., mixers, vanes, baffles, blades, etc.) may be positioned within the mixer module housing 442 and configured to facilitate mixing of the reductant with the exhaust gas. The mixer module 440 may also be distinct from the aftertreatment module 450.

The aftertreatment module 450 includes an aftertreatment module housing 452 within which one or more aftertreatment components (e.g., the aftertreatment component 154) may be positioned. One or more aftertreatment components (e.g., the aftertreatment component 154) may be positioned within the aftertreatment module housing 452. A mixer module housing outer surface 445 of the mixer module housing 442 may be coupled to an aftertreatment module housing outer surface 455 of the aftertreatment module housing 452 such that the mixer module housing outer surface 445 is at the aftertreatment module housing outer surface 455, and continuous therewith. For example, an outermost extent of the mixer module housing outer surface 445 in a direction perpendicular to the longitudinal axis $A_L$ is at the innermost extent of the aftertreatment module housing outer surface 455 in the same direction.

The noise reduction module 460 comprises a noise reduction module housing 462 within which one or more noise reduction components (e.g., the noise reduction component 164) may be positioned. The noise reduction module housing 462 comprises an outlet 463 having an outlet flange 467 attached thereto for fluidly coupling the outlet 463 to an outlet conduit (e.g., the outlet conduit 168). Each of the inlet flange 403 and the outlet flange 467 may comprise a Marmon flange, as shown in FIG. 4. In other embodiments, the inlet flange 403 and the outlet flange 467 may comprise a socket weld flange, a thread flange, a slip-on flange or a lap joint flange.

Furthermore, the outlet 463 is oriented along the longitudinal axis $A_L$ of the aftertreatment system 400. A noise reduction module housing outer surface 465 of the noise reduction module housing 462 is coupled to the aftertreatment module housing outer surface 455 of the aftertreatment module housing 452 at an interface 466 (e.g., a welded joint) such that an outermost extent of the noise reduction module housing outer surface 465 in a direction perpendicular to the longitudinal axis $A_L$ is at an innermost extent of the aftertreatment module housing outer surface 455 in the same direction. Furthermore, the noise reduction module housing 462 may have substantially the same cross-sectional shape as the aftertreatment module housing 452 in a plane perpendicular to the longitudinal axis $A_L$.

Figure 5:
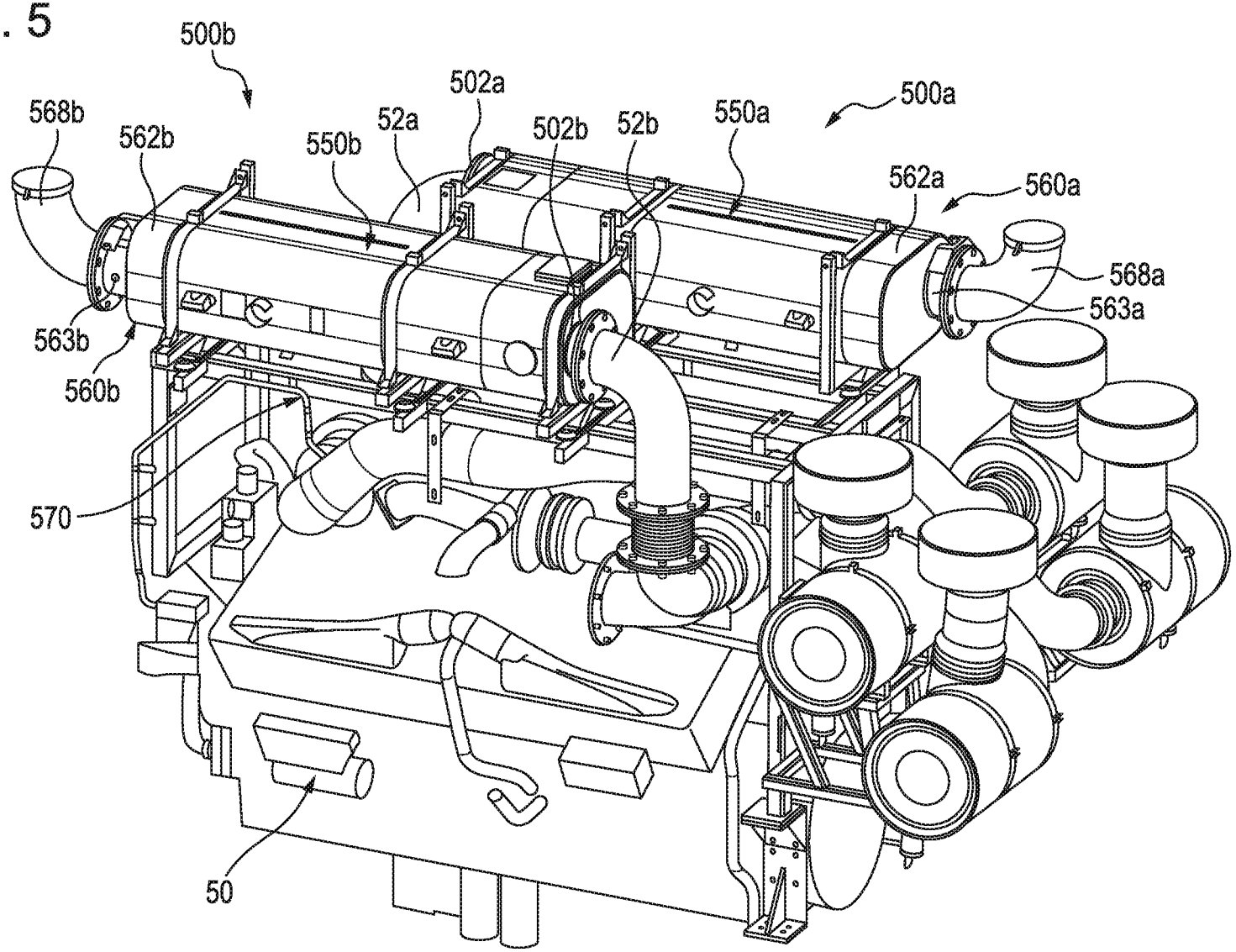
FIG. 5 is a perspective view of an engine with a set of aftertreatment systems including noise reduction modules mounted thereon, according to an embodiment.

FIG. 5 is a perspective view of an engine 50 having a first aftertreatment system 500*a* and a second aftertreatment system 500*b* fluidly coupled thereto, according to an embodiment. The engine 50 may include, for example, a diesel, gasoline, natural gas, ethanol, E85, biodiesel, dual fuel or any other suitable engine 50. In various embodiments, the engine 50 may include a high horsepower engine. A first inlet conduit 52*a* and a second inlet conduit 52*b* are fluidly coupled to an engine exhaust of the engine 50 and configured to receive an exhaust gas first portion and an exhaust gas second portion from the engine 50, respectively.

The first aftertreatment system 500*a* and the second aftertreatment system 500*b* are mounted on a support structure 570, which may include a plurality of cross-bars or structures configured to support the aftertreatment systems 500*a/b* thereon. The aftertreatment systems 500*a/b* are positioned parallel to each other and oriented in opposing directions to each other with respect to an axial flow axis of the exhaust gas flowing therethrough.

Each of the aftertreatment systems 500*a/b* comprises an aftertreatment module 550*a/b* and a noise reduction module 560*a/b* fluidly coupled to the aftertreatment module 550*a/b* such that the noise reduction module 560*a/b* is continuous with the aftertreatment module 550*a/b*. An outermost extent of a noise reduction module housing outer surface of the noise reduction modules 560*a/b* in a direction perpendicular to a longitudinal axis of the aftertreatment system 500*a/b* is at an innermost extent of an aftertreatment module housing outer surface of the aftertreatment module 550*a/b* in the same direction. The aftertreatment module 550*a/b* includes an inlet 502*a/b* fluidly coupled to the inlet conduit 52*a/b* and configured to receive the first and second exhaust gas portions therefrom, respectively. The noise reduction module 560*a/b* include an outlet 563*a/b* having an outlet conduit 568*a/b* coupled thereto for expelling treated exhaust gas into the atmosphere.

Figure 6:
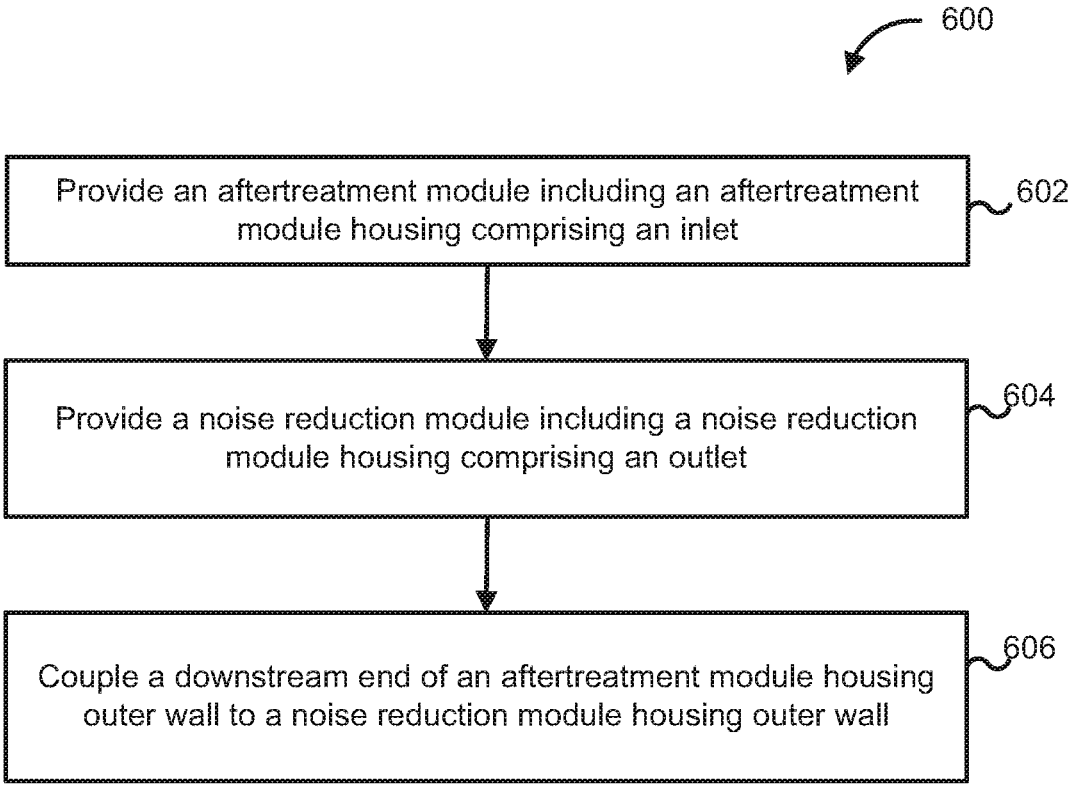
FIG. 6 is a schematic flow diagram of a method for providing an aftertreatment system with noise reduction features, according to a particular embodiment.

FIG. 6 is a schematic illustration of a method 600 for forming an aftertreatment system (e.g., the aftertreatment system 100), according to an embodiment. The method 600 comprises providing an aftertreatment module comprising an aftertreatment module housing, at 602. The aftertreatment module housing comprises an inlet for receiving an exhaust gas. For example, the aftertreatment module may include the aftertreatment module 150, 250, 350, 450, 550*a/b* or any other aftertreatment module described herein. One or more aftertreatment components (e.g., the aftertreatment component 154) may be positioned within the aftertreatment module housing.

At 604, a noise reduction module comprising a noise reduction module housing is provided. The noise reduction module is distinct from the aftertreatment module (i.e., is an independent component). The noise reduction module housing comprises an outlet for expelling treated exhaust gas into the atmosphere. The noise reduction module may include, for example, the noise reduction module 160, 260, 360, 460, 560*a/b* or any other noise reduction module described herein. One or more noise reduction components (e.g., the noise reduction component 164) may be disposed within the noise reduction module housing.

At 606, a noise reduction module housing outer surface of the noise reduction module housing is coupled (e.g., welded) to an aftertreatment module housing outer surface of the aftertreatment module housing such that an outermost extent of the noise reduction module housing outer surface in a direction perpendicular to the longitudinal axis $A_L$ of the aftertreatment system is at or inward of an innermost extent of the aftertreatment module housing outer surface in the same direction. Furthermore, the coupling may cause the noise reduction module housing outer surface to be continuous with the aftertreatment module housing outer surface. For example, the noise reduction module housing outer surface 165, 265, 365, 465 may be coupled to the aftertreatment module housing outer surface 155, 255, 355, 455 so as to be at or inward of the aftertreatment module housing outer surface 155, 255, 355, 455 and may also be continuous therewith.

For example, the noise reduction module housing (e.g., the noise reduction module housing 162, 262, 362, 462, 562*a/b*) may have a cross-sectional shape which is substantially the same as a cross-sectional shape of the aftertreatment module housing (e.g., aftertreatment module housing 152, 252, 352, 452, 552*a/b*) in a plane perpendicular to the longitudinal axis of the aftertreatment system (e.g., the aftertreatment system 100, 200, 300, 400, 500*a/b*). Furthermore, the inlet of the aftertreatment housing and/or the outlet of the module housing may be oriented parallel to a longitudinal axis of the aftertreatment system (e.g., axially aligned in a longitudinal direction of the aftertreatment system), oriented perpendicular to the longitudinal axis, or oriented in any other direction relative to the longitudinal axis of the aftertreatment system.

Figure 7A:
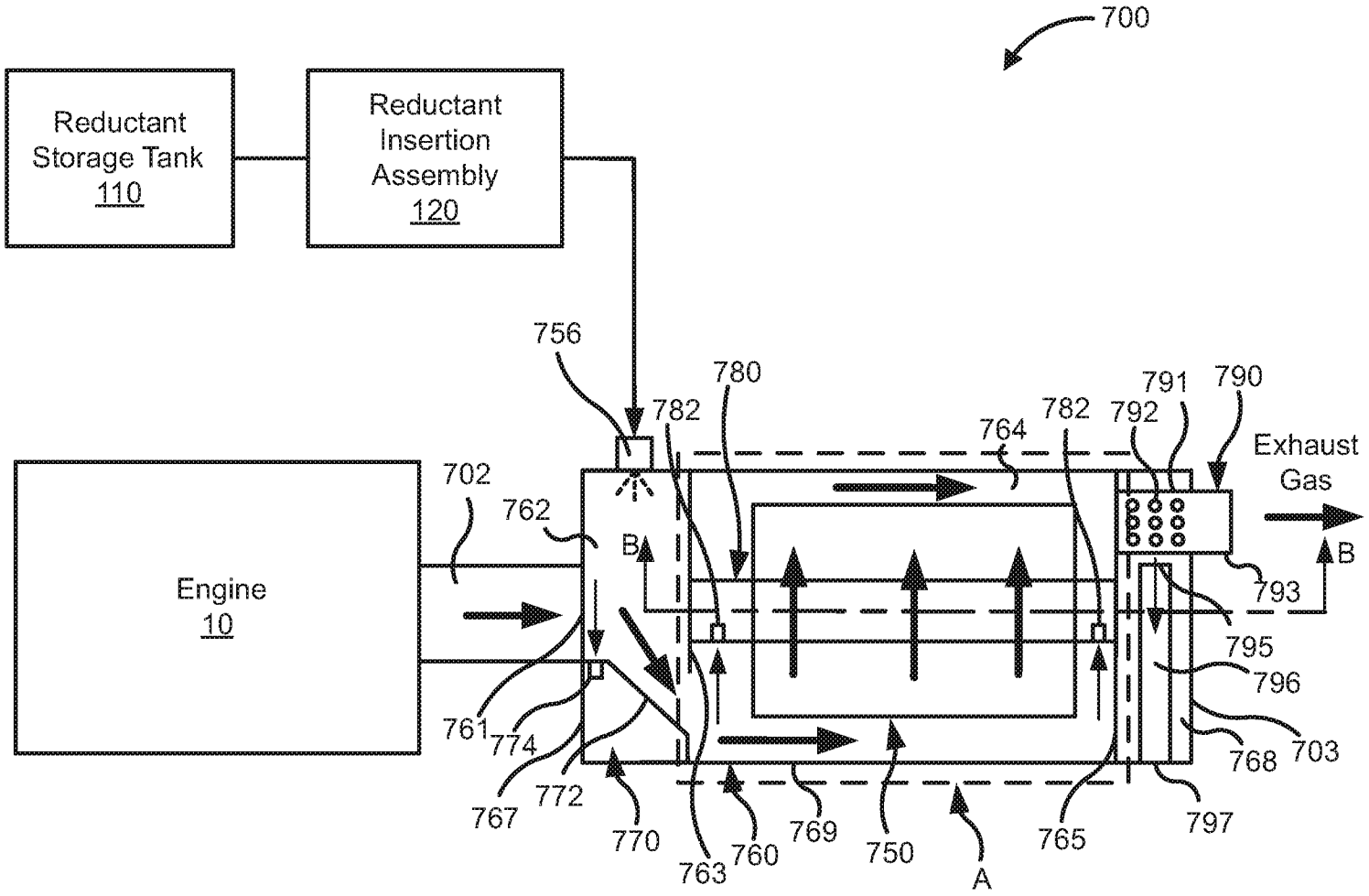
FIG. 7A is schematic illustration of an aftertreatment system, according to an embodiment.

FIG. 7A is a schematic illustration of an aftertreatment system 700, according to an embodiment. The aftertreatment system 700 may be coupled to the engine 10 and configured to reduce constituents of an exhaust gas produced by the engine 10. The aftertreatment system 700 may comprise the reductant storage tank 110, the reductant insertion assembly 120, an aftertreatment component 750, a housing 760 and a plurality of noise reducing components 770, 780, 790 and 794.

The reductant storage tank 110 is structured to store a reductant, as previously described herein. The reductant insertion assembly 120 is fluidly coupled to the reductant storage tank 110 and configured to receive the reductant therefrom. In some embodiments, the reductant insertion assembly 120 may be configured to selectively insert the reductant into the housing 760 upstream of the aftertreatment component 750. In other embodiments, the reductant insertion assembly 120 may be configured to insert the reductant in an inlet conduit 702 coupled to an inlet 761 of the housing 760.

In particular embodiments, the aftertreatment component 750 may include an SCR system including an SCR catalyst formulated to selectively decompose constituents of the exhaust gas, as previously described herein. In other embodiments, the aftertreatment component may include an oxidation catalyst (e.g., a diesel oxidation catalyst), a filter (e.g., particulate matter filter, a partial filter, etc.), an ammonia oxidation catalyst (AMOx) or any other aftertreatment component. Although FIG. 7A shows only one aftertreatment component 750 positioned within the internal volume of the housing 760, in other embodiments, a plurality of aftertreatment components may be positioned within the housing 760 in addition to the aftertreatment component 750 (e.g., an SCR catalyst). Such aftertreatment components may comprise, for example, filters (e.g., particulate matter filters, catalyzed filters, etc.), oxidation catalysts (e.g., carbon monoxide, hydrocarbons and/or ammonia oxidation catalysts), mixers, baffle plates, or any other suitable aftertreatment component.

A reductant insertion port 756 may be provided on a sidewall of housing 760 and structured to allow insertion of a reductant therethrough into the internal volume thereof. The reductant insertion port 756 may be positioned upstream of the aftertreatment component 750 (e.g., an SCR catalyst to allow reductant to be inserted into the exhaust gas upstream of the SCR catalyst), for example, in an inlet chamber 762 of the housing 760. In other embodiments, the reductant insertion port 756 may be disposed on the inlet conduit 702 and configured to insert the reductant into the inlet conduit 702 upstream of the aftertreatment component 750. In such embodiments, mixers, baffles, vanes or other structures may be positioned in an inlet conduit 702 so as to facilitate mixing of the reductant with the exhaust gas.

The housing 760 may be formed from a rigid, heat-resistant and corrosion-resistant material, for example stainless steel, iron, aluminum, metals, ceramics, or any other suitable material. The housing 760 may have any suitable cross-section, for example circular, square, rectangular, oval, elliptical, polygonal, or any other suitable shape. The housing 760 comprises an inlet 761 structured to receive the exhaust gas via the inlet conduit 702.

A plurality of noise reducing components are positioned within the housing 760. As previously described herein, in conventional aftertreatment systems, noise reducing components are positioned downstream of a housing of the aftertreatment system, for example, coupled to an outlet of conventional aftertreatment system such that substantially all noise reducing functions are performed downstream of such conventional aftertreatment systems. In contrast, the aftertreatment system 700 includes noise reducing components positioned within the internal volume defined by the housing 760 such that the noise is reduced as the exhaust gas flows through the aftertreatment system 700. This obviates the use of a separate noise reduction module downstream of the aftertreatment system 700, thereby allowing significant reduction in length of the aftertreatment system 700 relative to conventional aftertreatment systems as well as providing flexibility in mounting the aftertreatment system 700 on mounting structures.

The aftertreatment system 700 includes a first Helmholtz resonator (HR) 780 that provides a noise reducing component extending around an outer periphery of the aftertreatment component 750. For example, the first HR 780 may circumferentially surround the aftertreatment component 750. A HR or Helmholtz oscillator is a container of gas (with an open hole, a neck or port) defined on a wall thereof. A volume of gas in and near the open hole vibrates because of the 'springiness' of the gas inside. The vibration may be tuned to target particular acoustic frequencies for reducing acoustic noise.

Figure 7B:
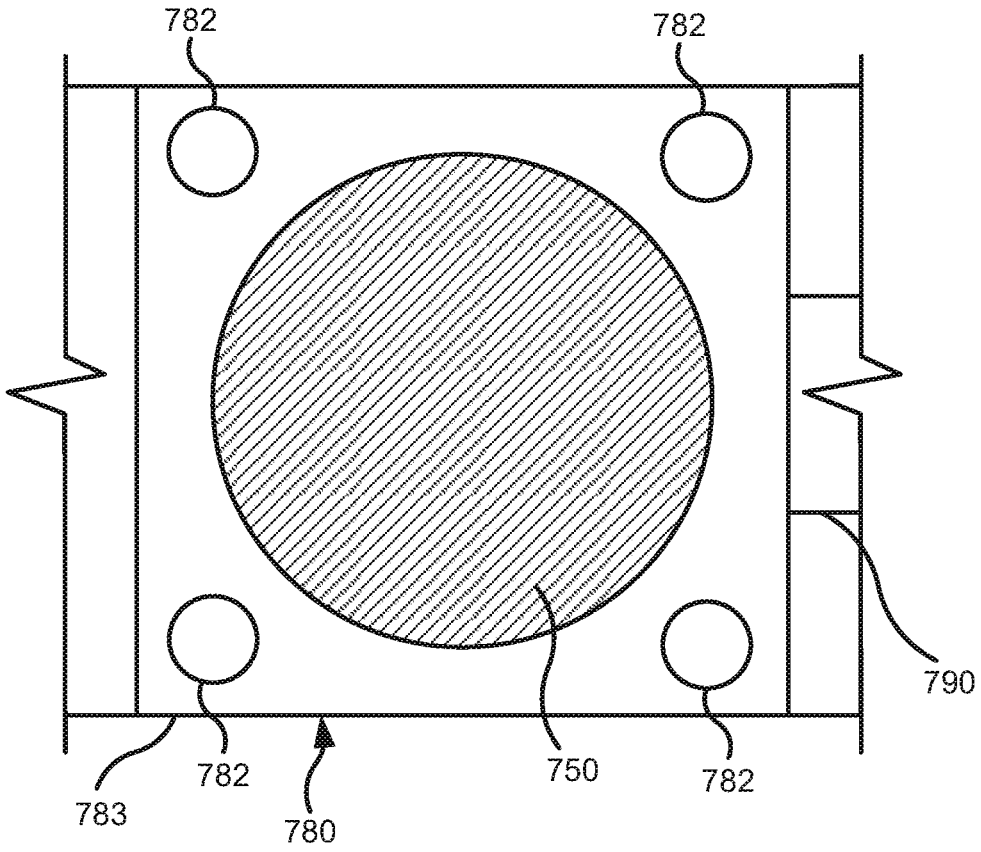
FIG. 7B is a top cross-section of a portion of the aftertreatment system of FIG. 7A indicated by the arrow A in FIG. 7A taken along the line B-B shown in FIG. 7A.
Figure 8A:
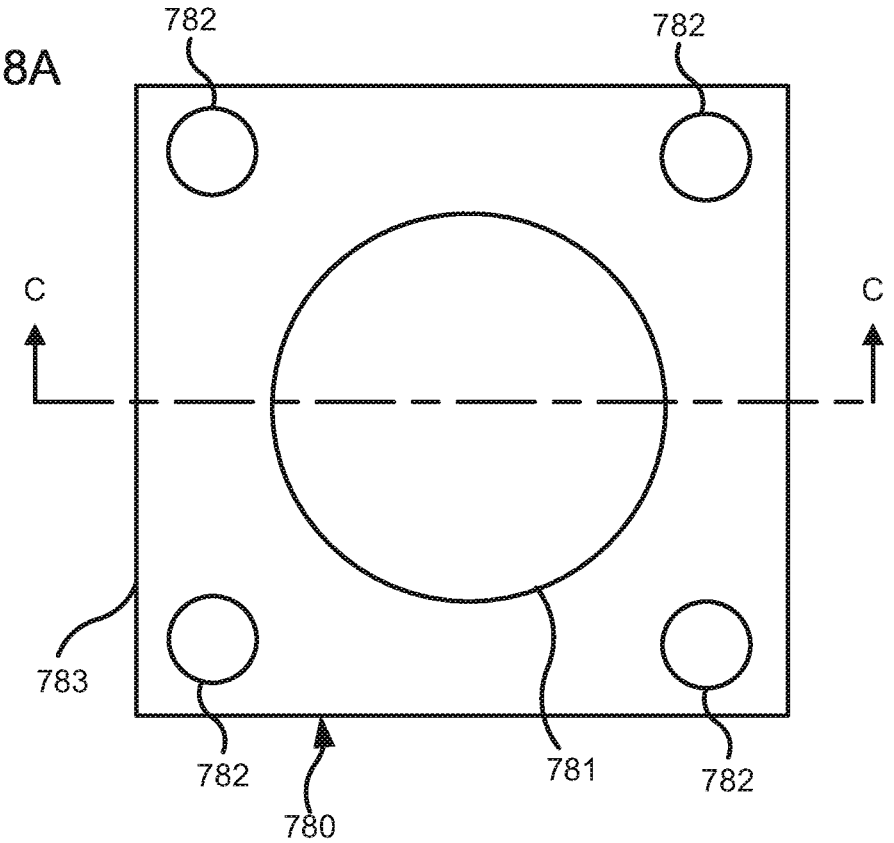
FIG. 8A is a bottom view of a noise reducing component included in the aftertreatment system of FIG. 6, according to an embodiment.

FIG. 7B is a top cross-section of a portion of the aftertreatment system 700 indicated by the arrow A in FIG. 7A. The first HR 780 includes a container defining a first HR internal volume. FIG. 8A shows a bottom view of the first HR 780 removed from the aftertreatment system 700. A channel 781 is defined through the container. The aftertreatment component 750 is positioned through the channel 781 such that the first HR 780 extends around an outer periphery of the aftertreatment component 750. In other words, the first HR 780 circumferentially surrounds the aftertreatment component 750. Outer sidewall 783 of the first HR 780 may abut corresponding sidewalls of the housing 760 as well as inner walls 763 and 765 disposed within the internal volume of the housing 760. For example, the walls 763 and 765 may define an aftertreatment component chamber 764 within the internal volume of the housing 760, within which the aftertreatment component 750 is disposed. The first HR 780 is positioned so as to fluidly seal the area around the aftertreatment component 750 such that a bulk of the exhaust gas is forced to flow through the aftertreatment component 750. A portion of the exhaust gas enters the first HR 780, causing the first HR 780 to resonate and provide noise reduction in a particular frequency range, as described herein.

The first HR 780 defines at least one first HR inlet tube 782 configured to allow a portion of the exhaust gas to enter the first HR internal volume. For example, as shown in FIG. 8A, the first HR 780 may include four HR inlet tubes 782 positioned at predetermined locations around the channel 781 (e.g., in a square or rectangular array with each first HR inlet tube 782 positioned at a corner of the array). As shown in FIG. 7A each of the first HR inlet tubes 782 are defined on a face of the first HR 780 facing the exhaust gas flow such that the exhaust gas cannot bypass the aftertreatment component 750. Resonant vibrations in the first HR 780 are tuned, for example, via controlling an internal volume of the container, a thickness of sidewalls of the container and/or a length of the first HR inlet tube 782, to target a particular acoustic frequency or acoustic frequency range {e.g., a low level (20 Hz to 250 Hz) to mid level (e.g., 250 Hz to 4 kHz) audible acoustic frequency range} generated by the exhaust gas.

Figure 8B:
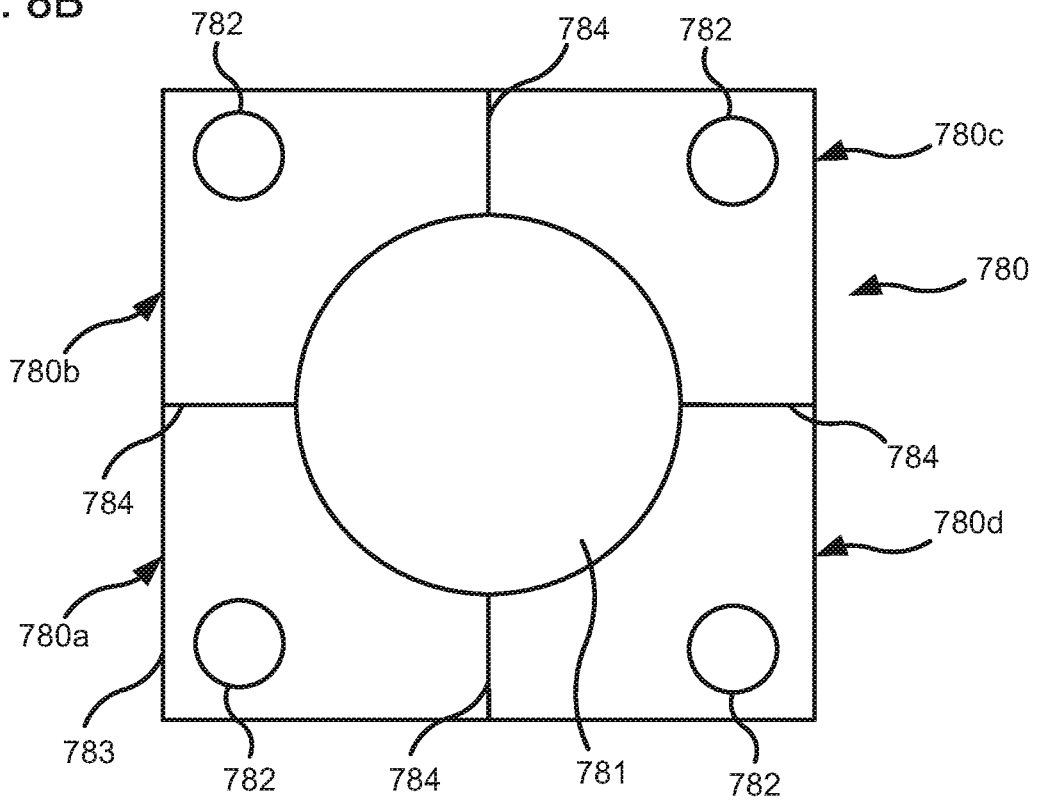
FIG. 8B is a bottom view of a noise reducing component included in the aftertreatment system of FIG. 6, according to another embodiment.
Figure 8C:
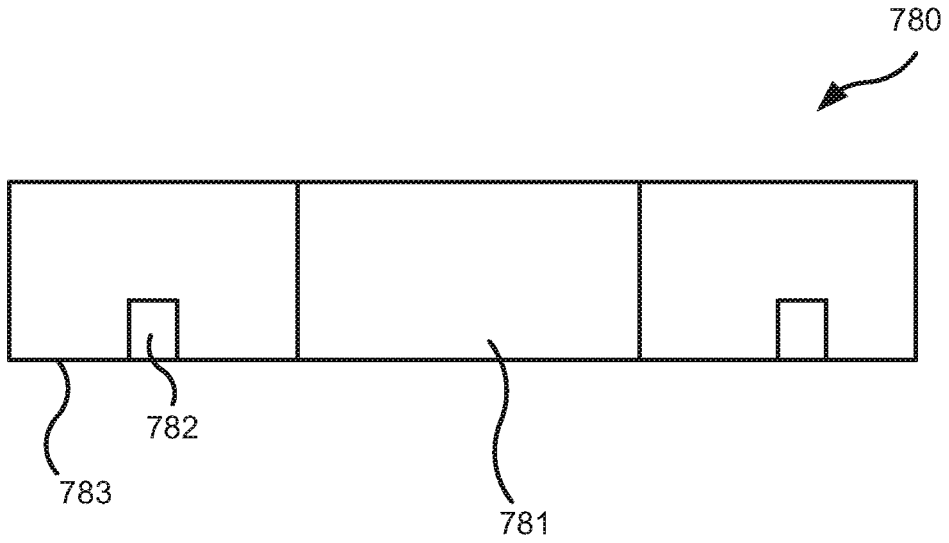
FIG. 8C is a side cross-section view of the noise reducing component of FIG. 8A taken along the line C-C shown in FIG. 8C.

In some embodiments, the first HR 780 may include a plurality of portions, each serving as an independent HR. For example, FIG. 8B shows the first HR 780 according to particular embodiment in which a plurality of walls 784 are positioned within the first HR internal volume. The plurality of walls 784 separate the first HR internal volumes into a plurality of portions 780*a/b/c/d* such that each of the first HR inlet tubes 782 correspond to one of the plurality of portions 780*a/b/c/d*. Each of the portions 780*a/b/c/d* is fluidly isolated from the others such that each portion serves as an independent HR resonator. In various embodiments, the plurality of walls 784 are positioned such that each portion 780*a/b/c/d* has equal volume (e.g., positioned at a 90 degree offset from each other). In other embodiments, the plurality of walls 784 may be positioned such that at least one of the portions 780*a/b/c/d* defines a volume different from volumes defined by other portions 780*a/b/c/d*, for example, to tune each portion 780*a/b/c/d* to target a specific acoustic frequency. In various embodiments, the aftertreatment system 700 may comprise a plurality of aftertreatment components and a plurality of first Helmholtz resonators, each of the plurality of first Helmholtz resonators extending around a corresponding aftertreatment component of the plurality of aftertreatment components.

In some embodiments, the aftertreatment system 700 may also include an upstream noise reducing component, for example, an upstream HR positioned upstream of the aftertreatment component 750. For example, as shown in FIG. 7A the housing 760 may define the inlet chamber 762 located upstream of the aftertreatment component chamber 764. The inlet 761 of the housing 760 is defined in a first sidewall 767 of the housing 760. The inlet 761 is structured to receive the exhaust gas via the inlet conduit 702. An upstream HR 770 is positioned in the inlet chamber 762.

The upstream HR 770 comprises a flow directing wall 772 configured to direct exhaust gas flow from the inlet 761 towards the aftertreatment component 750. The flow directing wall 772 has a first end positioned proximate to the inlet 761 and coupled to the first sidewall 767 of the housing 760. A second end of the flow directing wall 772 is coupled to a second sidewall 769 of the housing 760 distal from the inlet 761 such that the flow directing wall 772, the first sidewall 767 and the second sidewall 769 collectively define an upstream HR internal volume.

At least one upstream HR inlet tube is positioned through the flow directing wall 772 for allowing a portion of the exhaust gas to enter the upstream HR internal volume. For example, as shown in FIG. 7A, a first upstream HR inlet tube 774 is disposed through the flow directing wall 772 proximate to the inlet 761. In other embodiments, a second upstream HR inlet tube may also be disposed through the flow directing wall proximate to the second sidewall 769 of the housing 760. In such embodiments, the upstream HR internal volume may be divided into two chambers (e.g., via a wall positioned in the upstream HR internal volume), each of the first upstream HR inlet tube 774 and the second upstream HR inlet tube fluidly coupled to the corresponding chamber. The HR inlet tube 774 allows a portion of the exhaust gas to enter the upstream HR internal volume causing the upstream HR to resonate and reduce acoustic noise.

The aftertreatment system 700 may also include one or more noise reducing components positioned downstream of the aftertreatment component 750 within the internal volume defined by the housing 760. For example, a perforated tube 790 is disposed downstream of the aftertreatment component 750. The perforated tube 790 is disposed through an endwall 703 of the housing 760 such that the perforated tube 790 has a first portion 791 located within the internal volume of the housing 760 and a second portion 793 located outside of the internal volume of the housing 760 so as to form an outlet of the aftertreatment system 700. The first portion defines a plurality of perforations 792. As shown in FIG. 7A, the housing 760 defines an outlet chamber 768 between the wall 765 and the endwall 703 such that the first portion 791 of the perforated tube 790 is disposed in the outlet chamber 768. The perforations 792 of the perforated tube 790 are configured to allow a portion of the exhaust gas to be communicated into the outlet chamber 768 and cause a reduction in acoustic noise.

In some embodiments, a quarter wave tube 796 is positioned within the internal volume of the housing 760 downstream of the aftertreatment component 750, i.e., within the outlet chamber 768. A first end 795 of the quarter wave tube 796 is positioned proximate to the first portion 791 of the perforated tube 790 and structured to receive a portion of the exhaust gas via the plurality of perforations 792. A second end 797 of the quarter wave tube 796 is positioned distal from the perforated tube 790 and fluidly sealed from the internal volume. In other words, the second end 797 is closed. The quarter wave tube 796 may have a length configured to reduce acoustic noise in a particular frequency range. In particular embodiments, the perforated tube 790 and/or the quarter wave tube 796 may be configured to target a high level audible acoustic frequency range (e.g., in a range of 4 kHz to 20 kHz).

The aftertreatment system 700 may include one or more, or all of the noise reducing components described herein. In some embodiments, the combination of noise reducing components (e.g., the first HR 780, the upstream HR 770, the perforated tube 790 and/or the quarter wave tube 796) may be configured to reduce acoustic noise in the entire audible range, for example, in a range of 20 Hz to 20 kHz so as to provide an increase of about 10 dB to 15 dB in acoustic transmission loss, therefore providing significantly improved noise reductions relative to similar aftertreatment systems that do not include such noise reducing components. Furthermore, inclusion of the one or more noise reducing components in the aftertreatment system 700 has no impact on the aftertreatment performance (e.g., aftertreatment efficiency) of the aftertreatment system 700.

Figure 8D:
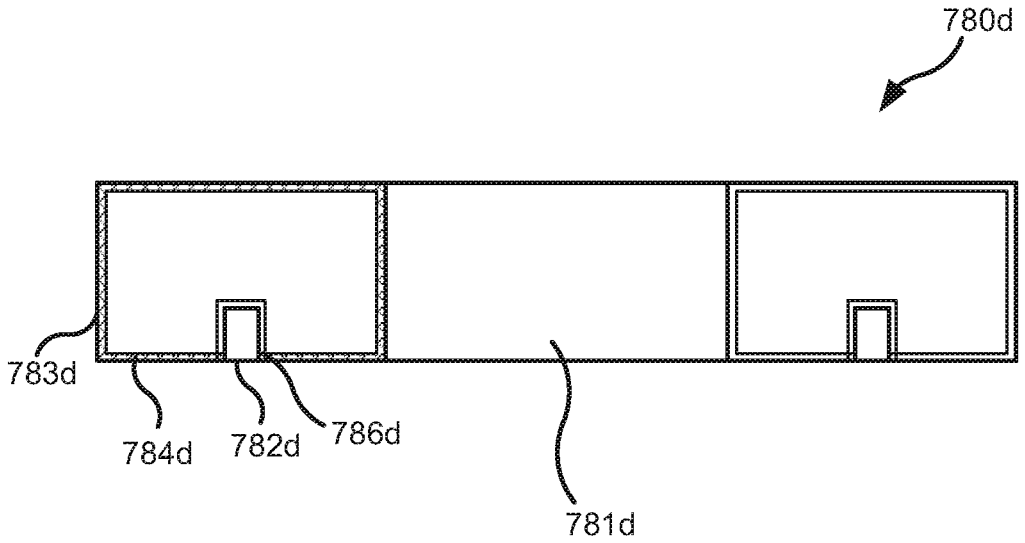
FIG. 8D is a side cross-section view of a noise reducing component, according to another embodiment.

In some embodiments, the first HR 780 or any other noise reducing component described herein may include a reactive noise reducing component, which does not include any acoustic damping material. For example, FIG. 8D shows a side cross-section view of the first HR 780. As previously described herein, the first HR 780 includes a hollow cavity defined by the sidewalls 783 with the first HR inlet tubes 782 extending therein. The first HR 780 may be formed from any suitable material, for example, sheet metal. The first HR 780 provides noise reduction via acoustic reflection, transmission and/or absorption.

In other embodiments, any of the HRs or other noise reducing components described herein may include dissipative noise reducing components. For example, FIG. 8D is a side cross-section view of another HR 780*d*, according to an embodiment. The HR 780*d* includes a cavity defined by sidewalls 783*d*, a channel 781*d* defined through the HR 780*d* and HR inlet tubes 782*d* positioned at predetermined locations in the HR 780*d*. The HR 780*d* is similar to the first HR 780, with the difference that an inner surface of the sidewalls 783*d* that form the cavity of the HR 780*d* are lined or coated with an acoustic damping material 784*d* (e.g., a porous absorber such as polyurethane foam or porous vinyl rubber, natural or synthetic fibers, fiber glass, mass loaded vinyl, silicone, acoustic damping paint, any other suitable acoustic damping material or a combination thereof). In some embodiments, a second lining 786*d* of the acoustic dampening material may also be provided on a surface of the HR inlet tube 782*d*. In various embodiments, the acoustic damping material may also be coated on an outer surface of the HR 780*d*. In other embodiments, an acoustic damping material may also be coated on any other noise reducing component (e.g., the upstream HR 770, the perforated tube 790 or the quarter wave tube 796) or any other surface of the housing 760. In still other embodiments, the aftertreatment system 700 or any other aftertreatment system described herein may be a hybrid aftertreatment system including a combination of reactive and dissipative noise reducing components.

Figure 9A:
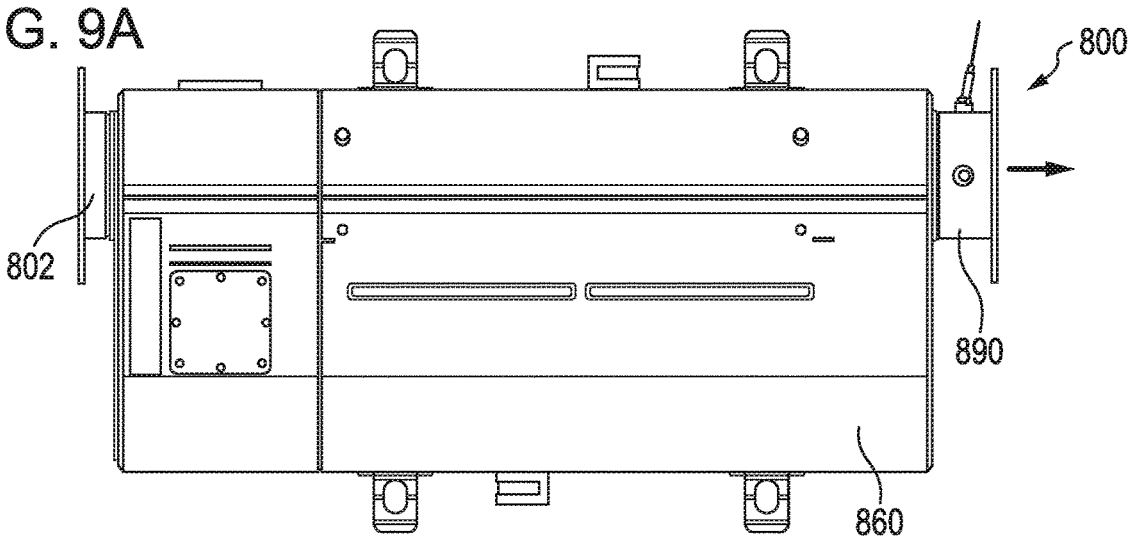
FIG. 9A is a side view and FIGS. 9B-9C are side cross-section views of an aftertreatment system, according to yet another embodiment.
Figure 9B:
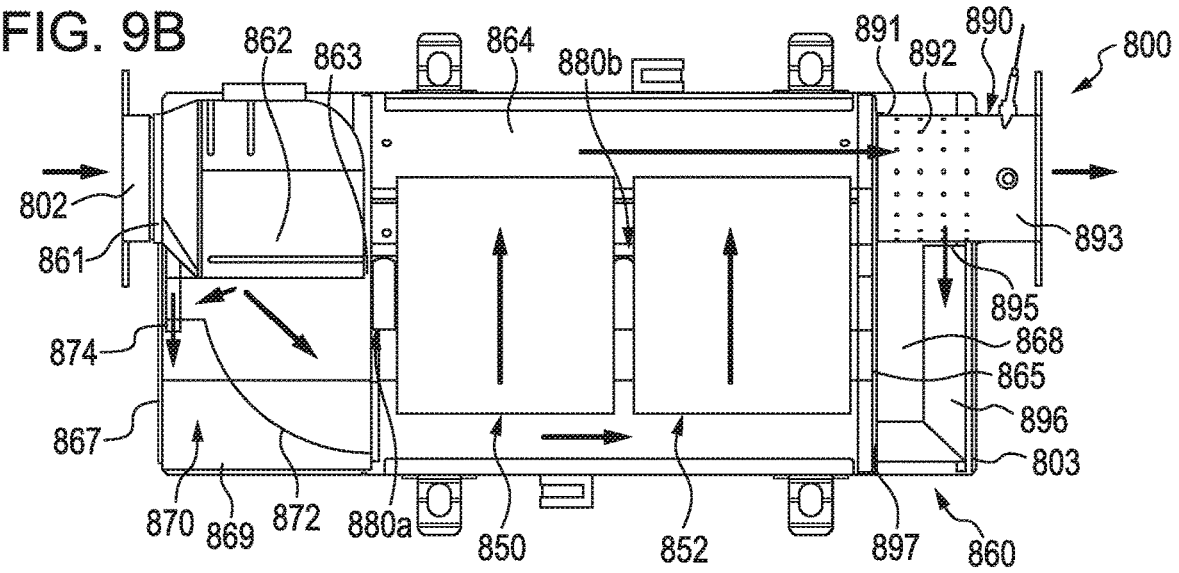
Figure 9C:
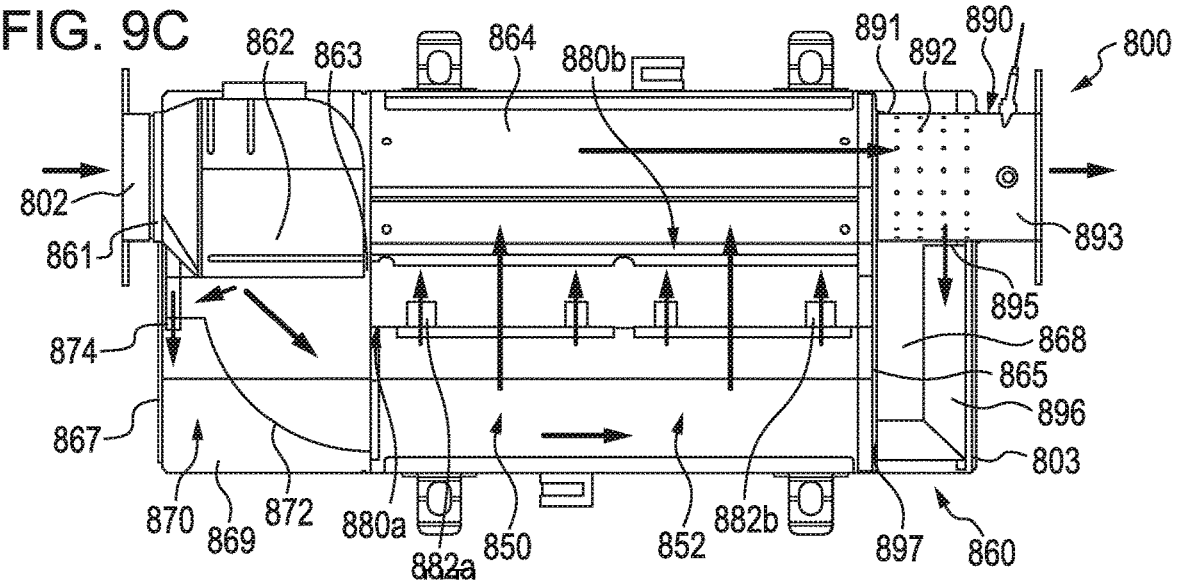

FIG. 9A is a side view, and FIGS. 9B and 9C are side cross-section views of an aftertreatment system 800, according to an embodiment. The aftertreatment system 800 may be coupled to an engine (e.g., the engine 10) and configured to reduce constituents of an exhaust gas produced by the engine. The aftertreatment system 800 comprises a plurality of noise reducing components disposed within a housing 860 of the aftertreatment system 800.

The internal volume of the housing 860 is divided into an inlet chamber 862 between a first sidewall 867 of the housing and a first wall 863 disposed within the internal volume of the housing 860, an aftertreatment component chamber 864 defined between the first wall 863 and a second wall 865, and an outlet chamber 868 defined between the second wall 865 and an endwall 803 of the housing 860. An inlet conduit 802 is coupled to the inlet chamber 862 and configured to deliver the exhaust gas to the aftertreatment system 800. A first aftertreatment component 850 is positioned in the aftertreatment component chamber 864 and may include a filter, an oxidation catalyst, or a SCR system. A second aftertreatment component 852 is disposed downstream of the first aftertreatment component 850 and may include a SCR system, an ammonia oxidation catalyst or a filter.

A plurality of noise reducing components are positioned within the housing 760. The aftertreatment system 800 comprises a first HR 880*a* extending around an outer periphery of the first aftertreatment component 850 and a second HR 880*b* extending around an outer periphery of the second aftertreatment component. The HR 880*a/b* includes a container defining a first HR internal volume. A channel is defined through the container of each of the first HR 880*a* and the second HR 880*b* through which the first aftertreatment component 850 and the second aftertreatment component 852 are positioned, respectively. The HR 880*a/b* is divided into four portions via walls disposed within the internal volume, and each portion is provided with a HR inlet tube 882*a/b* such that each portion serves as an independent Helmholtz resonator.

The aftertreatment system 800 also includes an upstream HR 870 positioned upstream of the aftertreatment component 850 in the inlet chamber 862. The upstream HR 870 comprises a flow directing wall 872 configured to direct exhaust gas flow from the inlet 861 towards the aftertreatment component 850. The flow directing wall 872 has a first end positioned proximate to the inlet 861 and coupled to the first sidewall 867 of the housing 860. A second end of the flow directing wall 872 is coupled to the second sidewall 869 of the housing 860 distal from the inlet 861 such that the flow directing wall 872, the first sidewall 867 and the second sidewall 869 collectively define an upstream HR internal volume. An upstream HR inlet tube 874 is disposed through the flow directing wall 872 proximate to the inlet 861.

A perforated tube 890 is disposed downstream of the second aftertreatment component 852 through the endwall 803 of the housing 860 such that the perforated tube 890 has a first portion 891 located within the internal volume of the housing 860 and a second portion 893 located outside of the internal volume of the housing 860 so as to form an outlet of the aftertreatment system 800. The first portion 891 defines a plurality of perforations 892 and is disposed in the outlet chamber 868. The perforations 892 of the perforated tube 890 are configured to allow a portion of the exhaust gas to be communicated into the outlet chamber 868 and cause a reduction in acoustic noise.

A quarter wave tubes 896 is positioned within the internal volume of the housing 860 downstream of the aftertreatment component 850, i.e., within the outlet chamber 868. While shown as including a single quarter wave tube in FIGS. 9B-9C, in other embodiments, the aftertreatment system 800 may include a pair of quarter wave tubes disposed in the outlet chamber 868. A first end 895 of the quarter wave tube 896 is positioned proximate to the first portion 891 of the perforated tube 890 and structured to receive a portion of the exhaust gas via the plurality of perforations 892. A second end 897 of the quarter wave tube 896 is positioned distal from the perforated tube 890 and coupled to the second wall 865 so as to be fluidly sealed from the internal volume. The quarter wave tube 896 may have a length configured to reduce acoustic noise in a particular frequency range. The combination of noise reducing components included in the aftertreatment system 800 may be configured to reduce acoustic noise in the entire audible range, for example, in a range of 20 Hz to 20 kHz so as to provide an increase of about 10 dB to 15 dB in acoustic transmission loss, therefore providing significant improvement in noise cancellation relative to similar aftertreatment systems that do not include such noise reducing components.

Figure 10A:
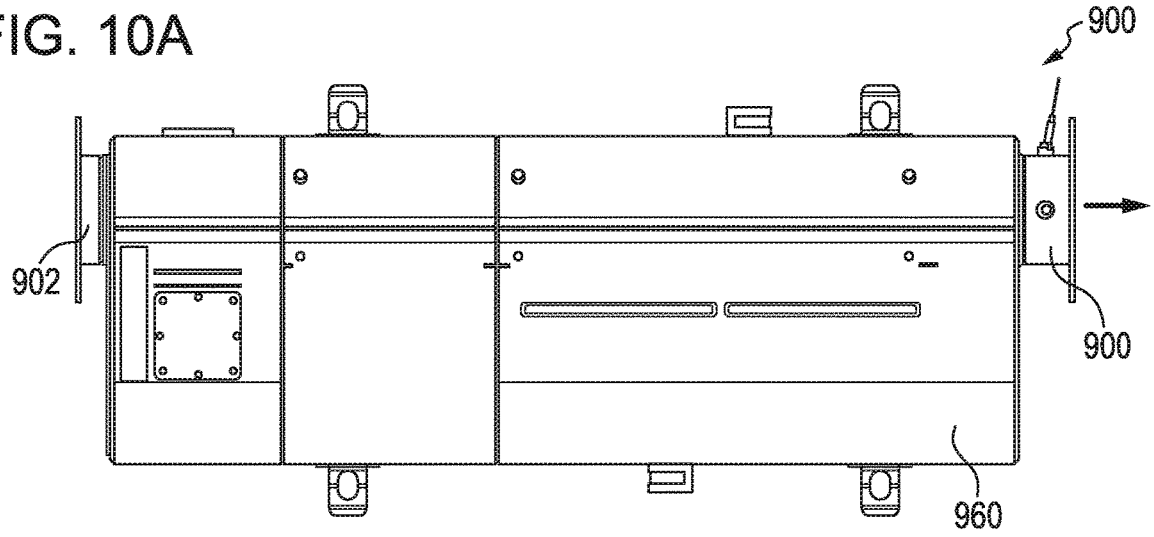
FIG. 10A is a side view and FIGS. 10B-10C are side cross-section views of an aftertreatment system, according to still another embodiment.
Figure 10B:
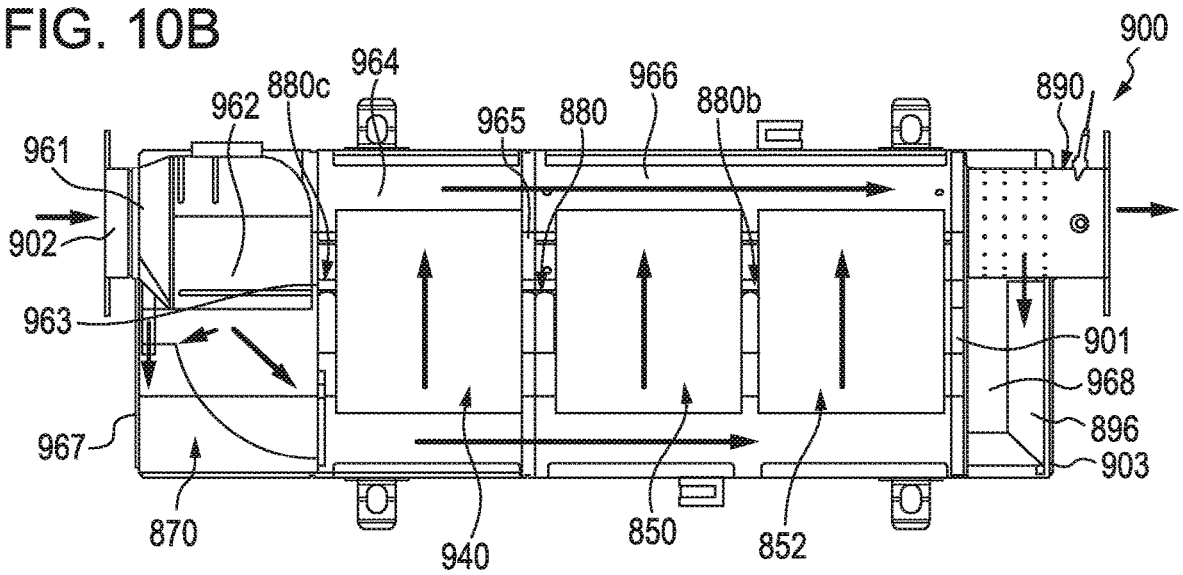
Figure 10C:
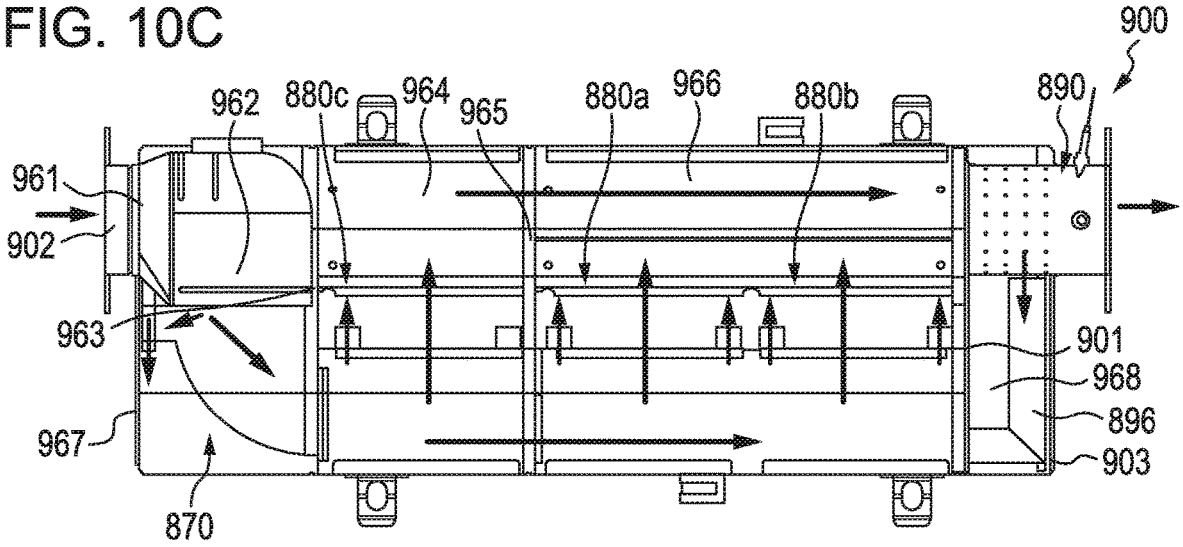

FIG. 10A is a side view, and FIGS. 10B and 10C are side cross-section views of an aftertreatment system 900, according to another embodiment. The aftertreatment system 900 may be coupled to an engine (e.g., the engine 10) and configured to reduce constituents of an exhaust gas produced by the engine. The aftertreatment system 900 is similar to the aftertreatment system 800, apart from the following differences.

The internal volume of a housing 960 of the aftertreatment system 900 is divided into an inlet chamber 962 between a first sidewall 967 of the housing and a first wall 963 disposed within the internal volume of the housing 960, an upstream aftertreatment component chamber 964 defined between the first wall 963 and a second wall 965, a second aftertreatment chamber 966 defined between the second wall 965 and a third wall 901, and an outlet chamber 968 defined between the third wall 901 and an endwall 903 of the housing 960. An inlet conduit 902 is coupled to the inlet chamber 962 and configured to deliver the exhaust gas to the aftertreatment system 900. The upstream HR 870 is disposed in the inlet chamber 962 and the first HR 880*a* and the second HR 880*b* are disposed in the second aftertreatment chamber extending around an outer periphery of their respective aftertreatment components 850 and 852. The perforated tube 890 and the quarter wave tube 896 are disposed in the outlet chamber 868. Different from aftertreatment system 800, an upstream aftertreatment component 940 (e.g., an oxidation catalyst) is disposed in the upstream aftertreatment component chamber 964. A third HR resonator 880*c* extends around an outer periphery of the upstream aftertreatment component 940 and may be similar in structure and function to the first and second HR resonators 880*a/b*.

Figure 11:
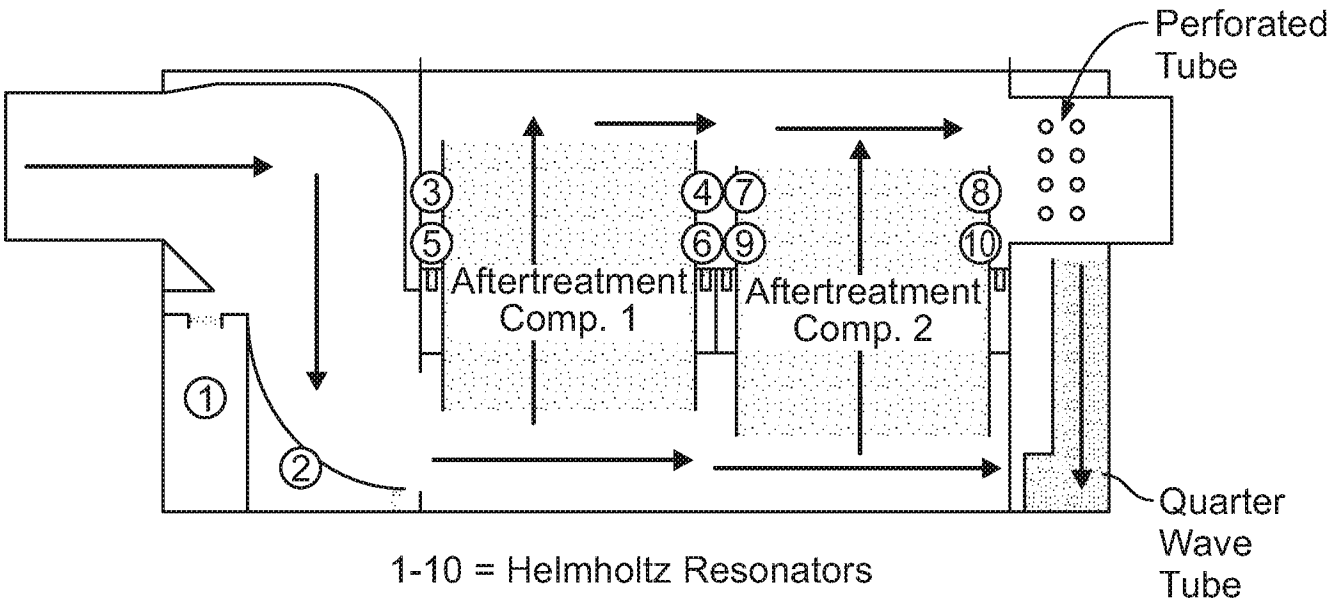
FIG. 11 is a schematic illustration of an aftertreatment system used to test acoustic transmission loss provided by noise reducing components positioned at various locations within an internal volume of the aftertreatment system.

FIG. 11 is illustration of a simulated model of an aftertreatment system. The aftertreatment system includes two upstream HRs, HR 1 and HR 2 each having an upstream HR inlet tube. Four HRs (HR 3, 4, 5 and 6) extend around portions of an outer periphery of a first aftertreatment component (aftertreatment component 1), and four HRs (HR 7, 8, 9 and 10) are extend around portions of an outer periphery of a second aftertreatment system (aftertreatment component 2), each having a corresponding inlet tube. The HRs extending around the first and second aftertreatment components include four cavities.

A perforated tube is positioned downstream of aftertreatment component 2 and forms an outlet of the aftertreatment system. A plurality of perforations are defined in a portion of the perforated tube positioned within the internal volume of the aftertreatment system. The perforated tube has a porosity of 3%. The aftertreatment system has overall dimensions as shown in FIG. 11.

Figure 12:
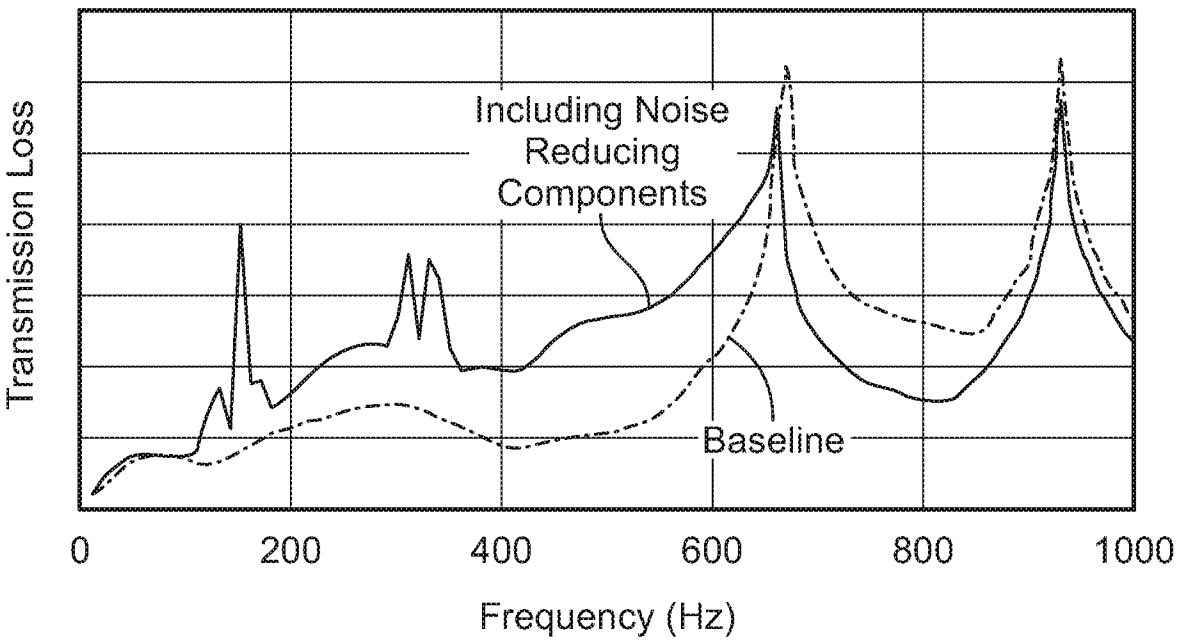
FIG. 12 shows plots of noise transmission loss of a base line aftertreatment system that is similar to the aftertreatment system of FIG. 11 but does not include any noise reducing components, and plots of noise transmission loss of the aftertreatment system of FIG. 11.

FIG. 12 shows plots of simulated acoustic transmission loss of the aftertreatment system of FIG. 11 and a simulated baseline aftertreatment system at various acoustic frequencies. The baseline aftertreatment system is similar to the aftertreatment system of FIG. 11 but does not include the noise reducing components of the aftertreatment system of FIG. 11. All simulations were performed for an exhaust gas flow rate of 1.62 kg/second and a temperature of 430 degrees Celsius. Significant increase in acoustic transmission loss is observed at various frequencies in the aftertreatment system of FIG. 11 relative to the baseline aftertreatment system. FIGS. 13-25 show plots of the impact of each of the noise reducing component of FIG. 11 demonstrated by excluding one noise reducing component from the aftertreatment component at a time and determining the acoustic transmission loss thereafter.

Figure 13:
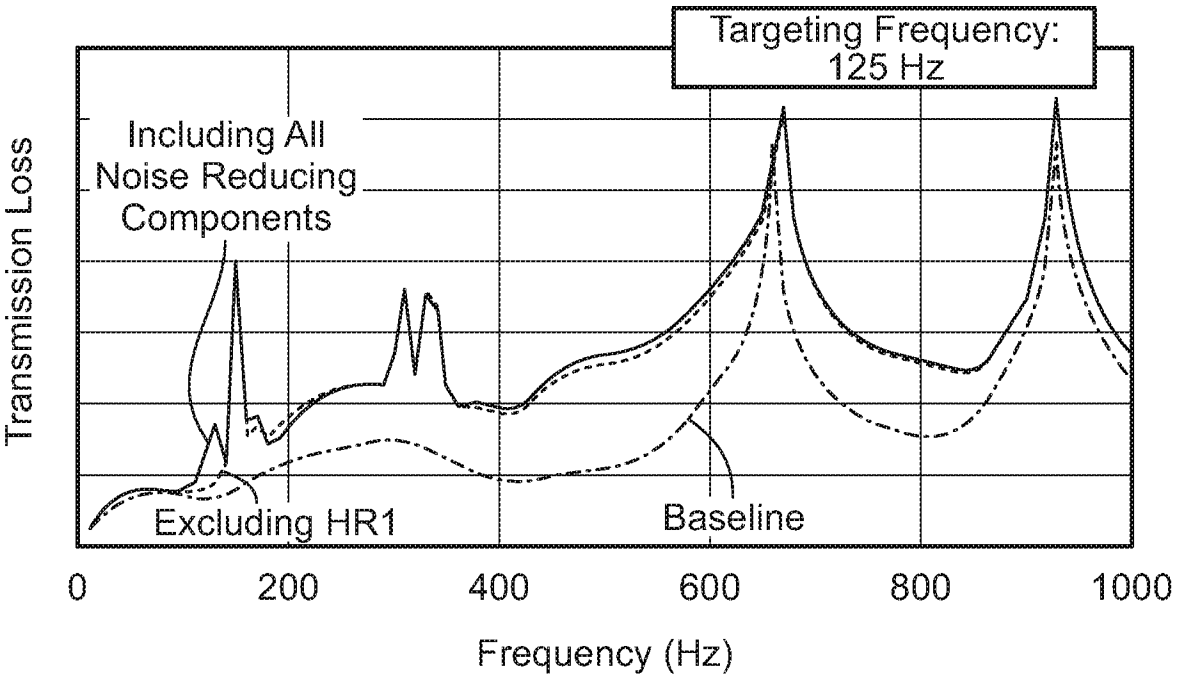
FIGS. 13-24 shows plots of noise transmission loss of the aftertreatment system of FIG. 11, the base line aftertreatment system and the aftertreatment system of FIG. 11 in response to exclusion of various noise reducing components from the aftertreatment system.

FIG. 13 is a plot of acoustic transmission loss of the aftertreatment system of FIG. 11 due to exclusion of HR 1 which targets an acoustic frequency of 125 Hz. A reduction in acoustic transmission loss is observed at the target frequency of 125 Hz corresponding to an increase in acoustic noise at the frequency.

Figure 14:
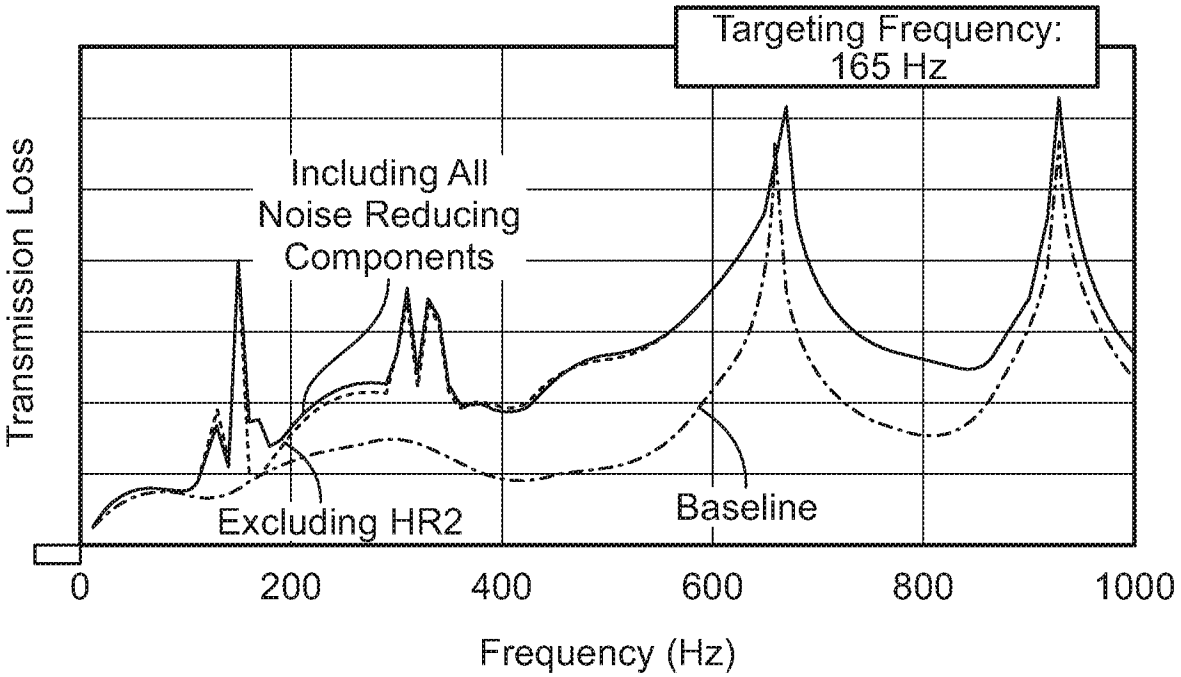
Figure 15:
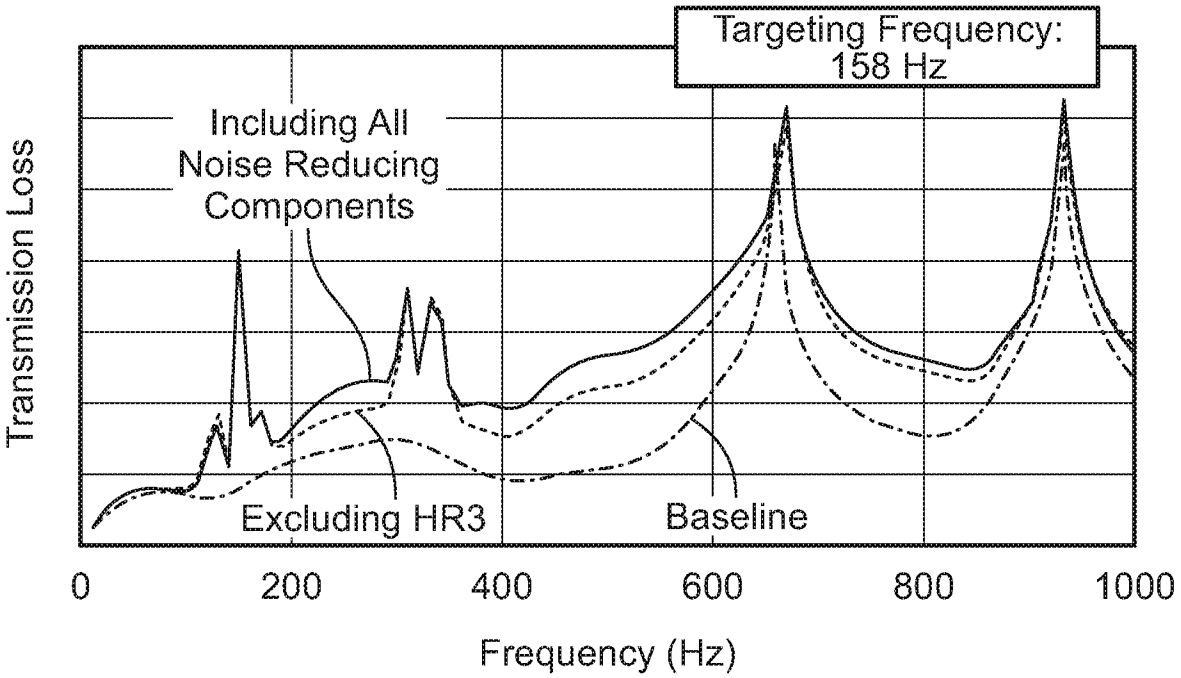
Figure 16:
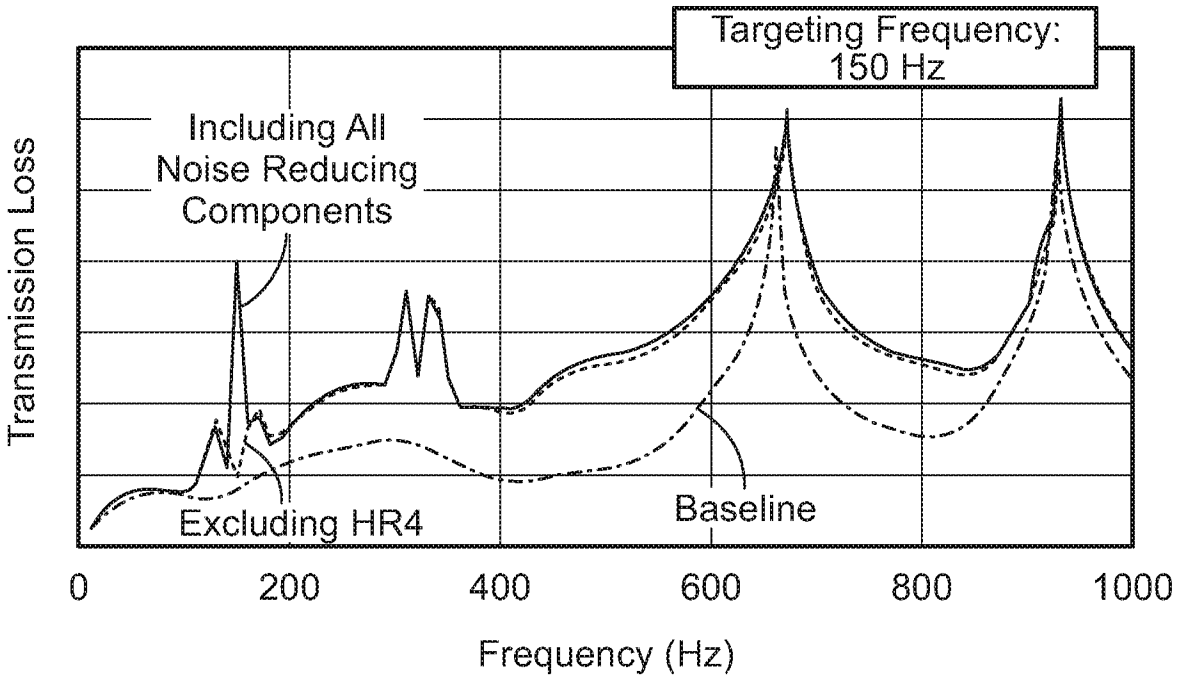
Figure 17:
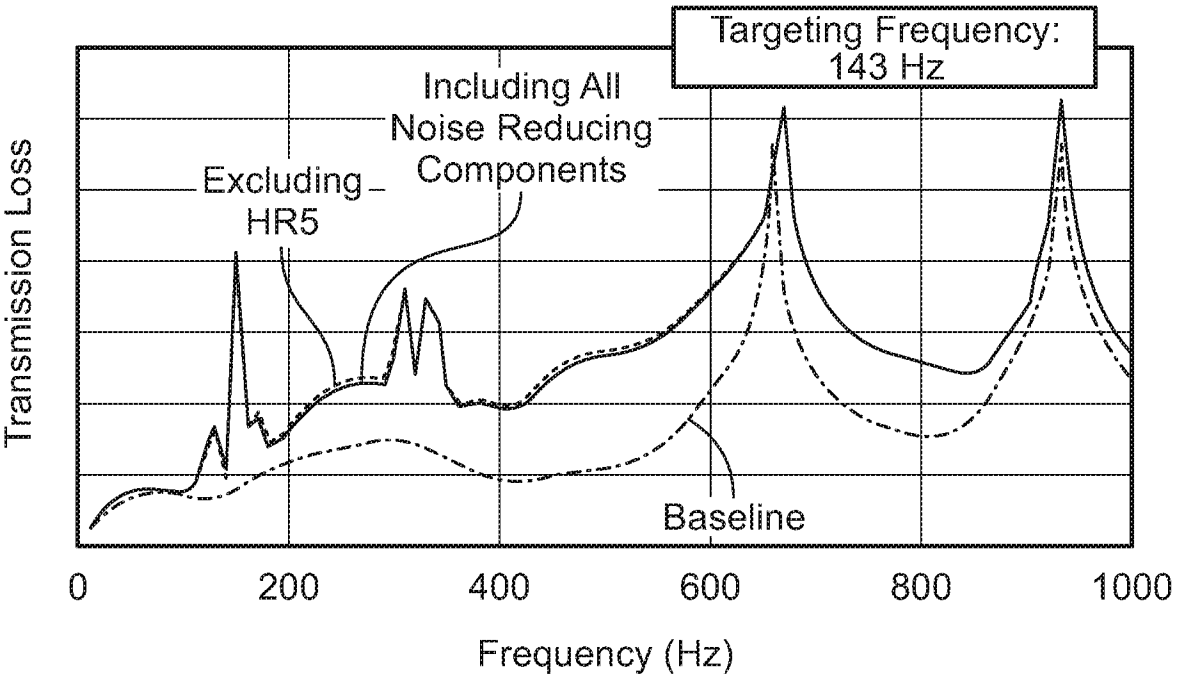
Figure 18:
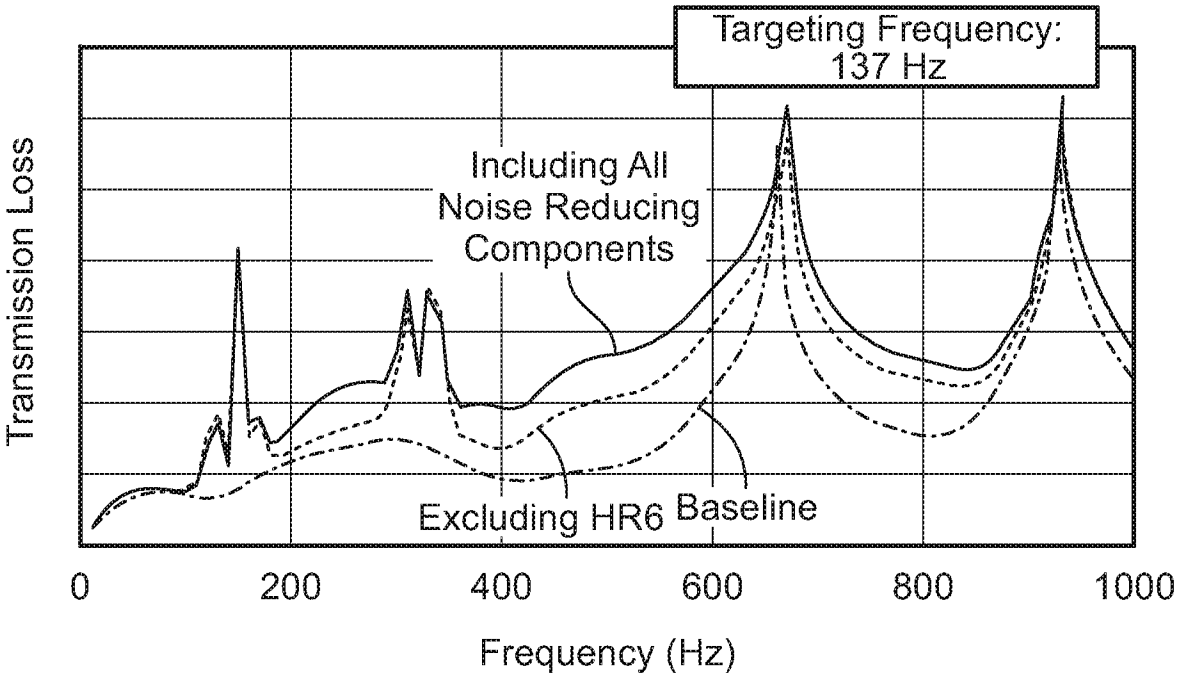
Figure 19:
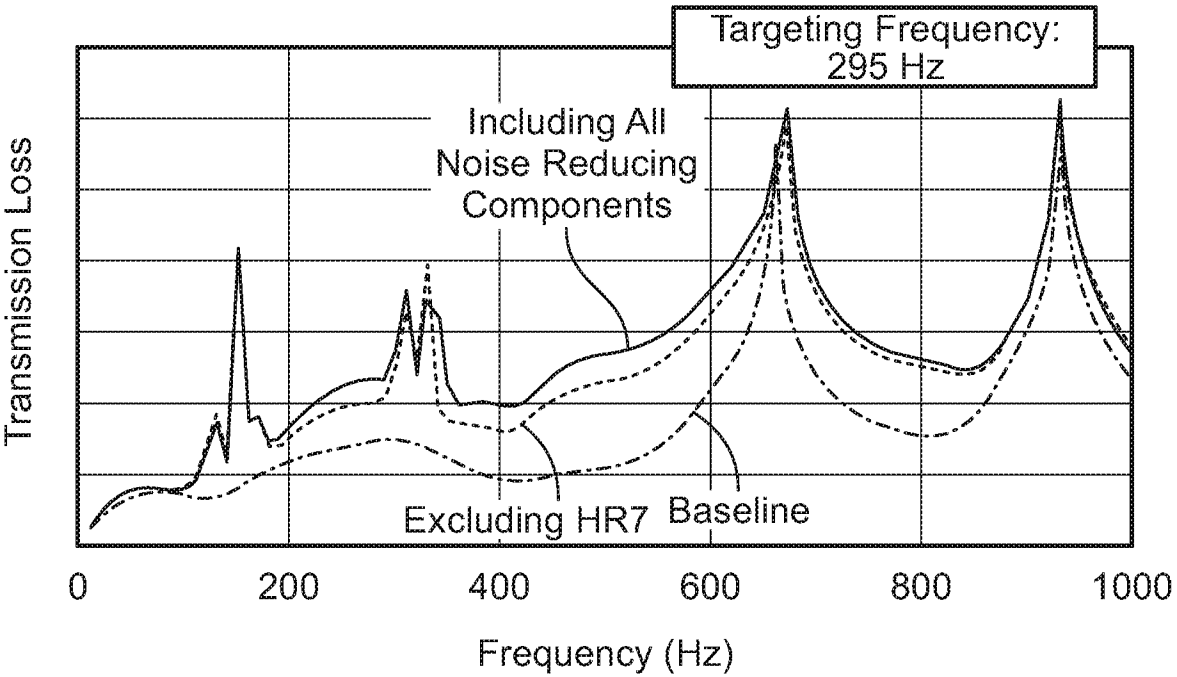
Figure 20:
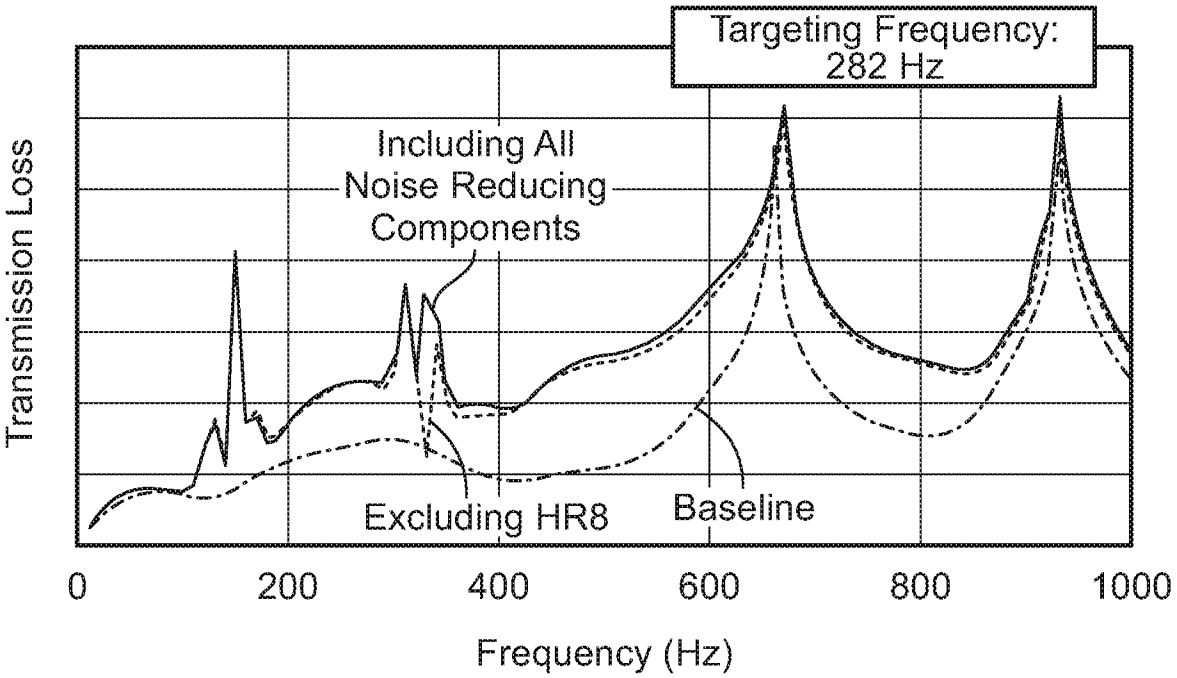
Figure 21:
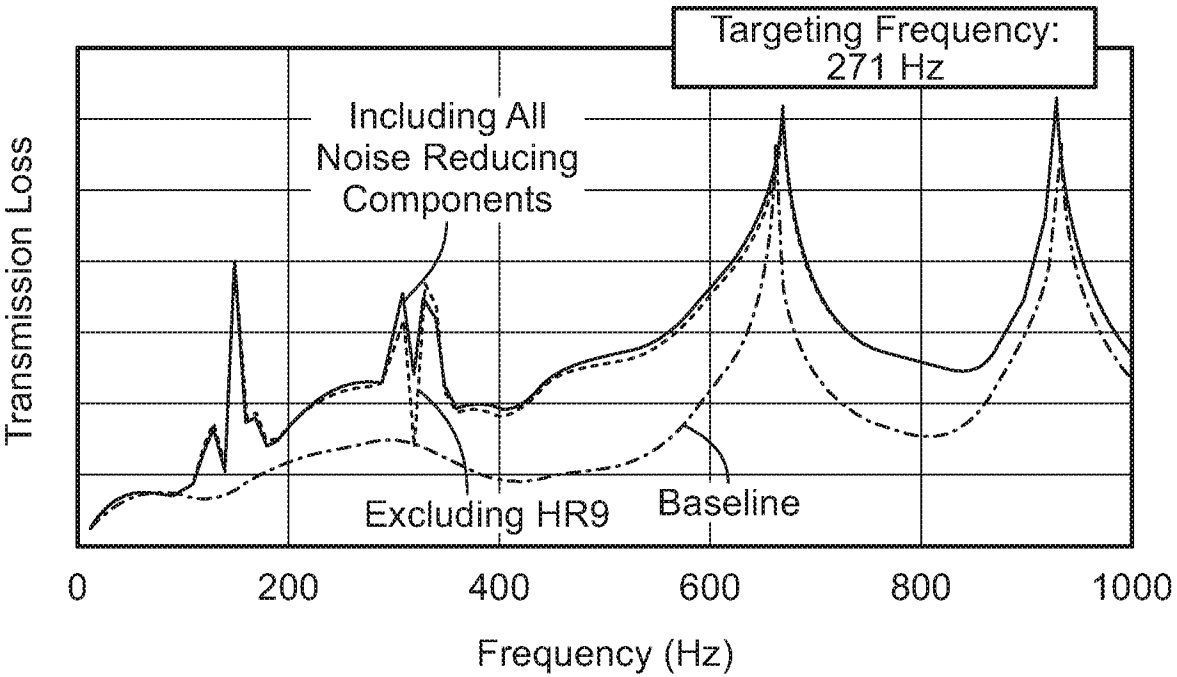
Figure 22:
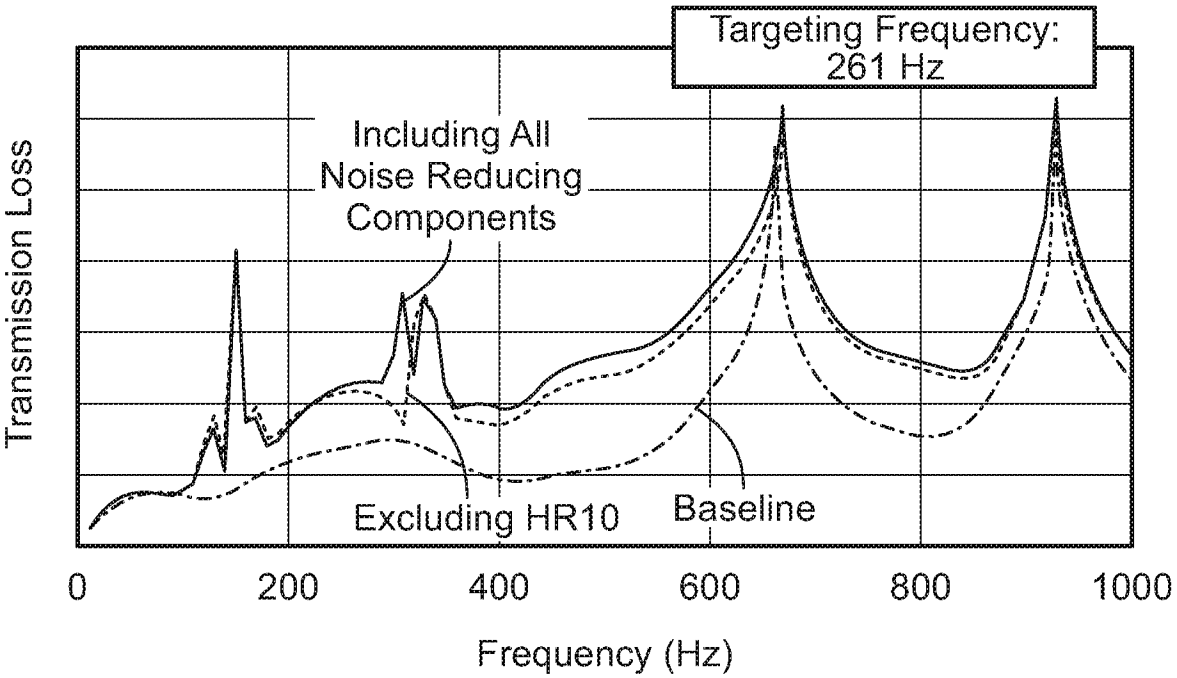
Figure 23:
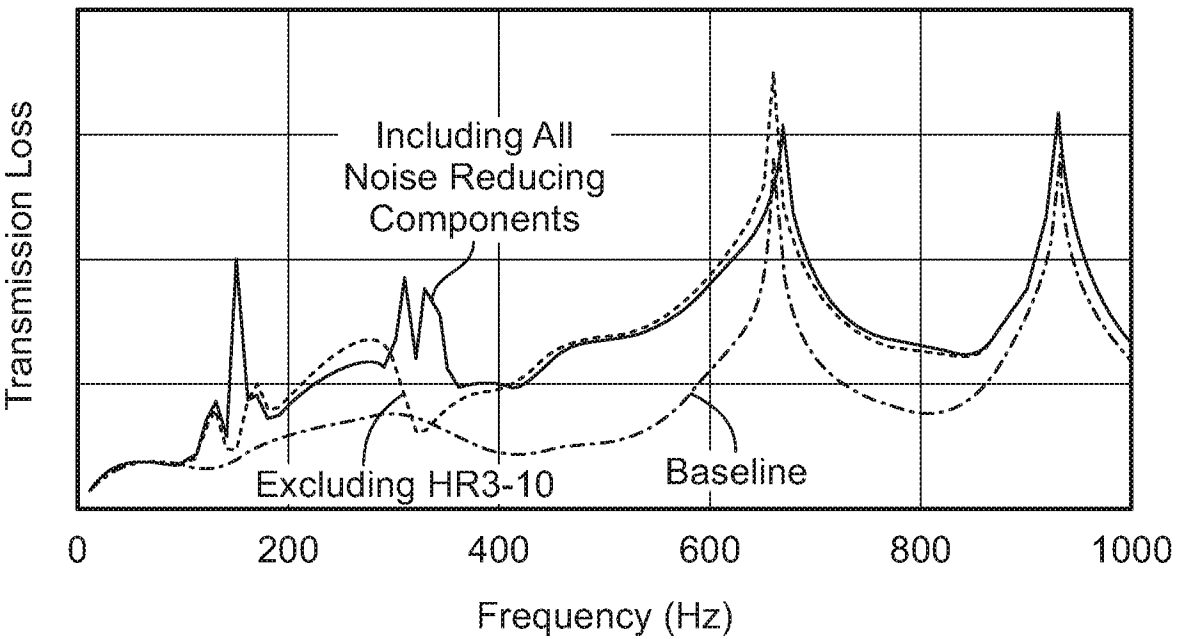
Figure 24:
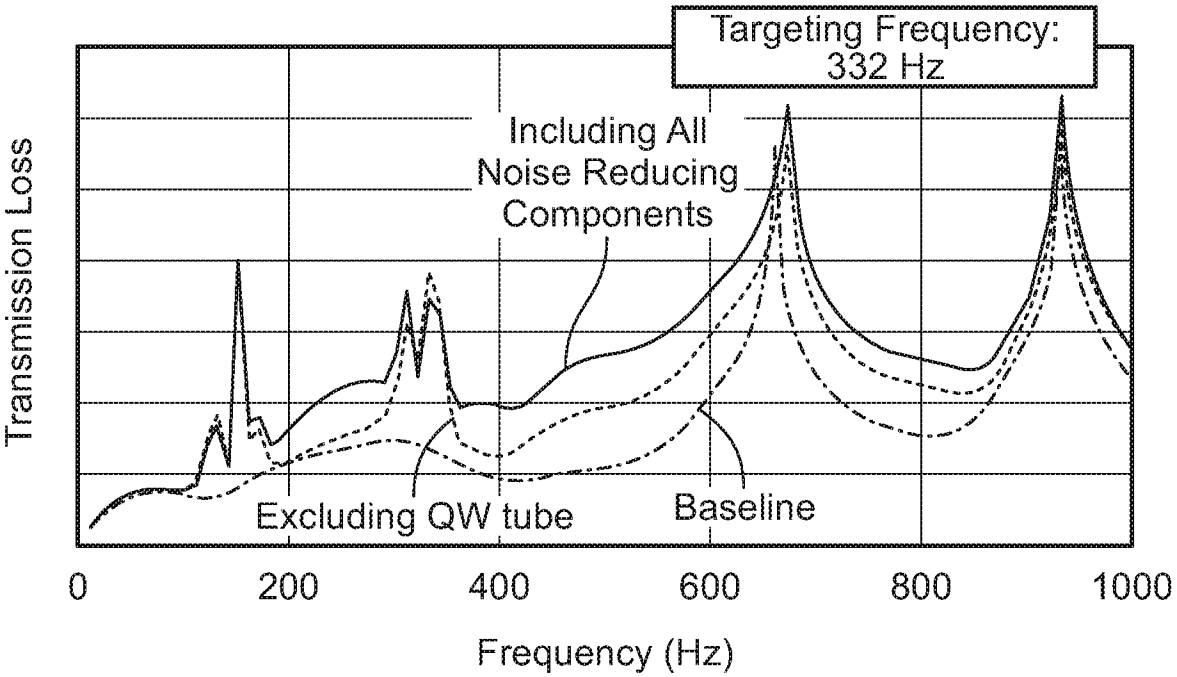

FIG. 14 is a plot of acoustic transmission loss of the aftertreatment system due to exclusion of HR 2 targeting an acoustic frequency of 165 Hz. FIG. 15 is a plot of acoustic transmission loss of the aftertreatment system due to exclusion of HR 3 targeting an acoustic frequency of 158 Hz. FIG. 16 is a plot of acoustic transmission loss of the aftertreatment system due to exclusion of HR 4 targeting an acoustic frequency of 150 Hz. FIG. 17 is a plot of acoustic transmission loss of the aftertreatment system due to exclusion of HR 5 targeting an acoustic frequency of 143 Hz. FIG. 18 is a plot of acoustic transmission loss of the aftertreatment system due to exclusion of HR 6 targeting an acoustic frequency of 137 Hz. FIG. 19 is a plot of acoustic transmission loss of the aftertreatment system due to exclusion of HR 7 targeting an acoustic frequency of 295 Hz. FIG. 20 is a plot of acoustic transmission loss of the aftertreatment system due to exclusion of HR 8 targeting an acoustic frequency of 282 Hz. FIG. 21 is a plot of acoustic transmission loss of the aftertreatment system due to exclusion of HR 9 targeting an acoustic frequency of 271 Hz. FIG. 22 is a plot of acoustic transmission loss of the aftertreatment system due to exclusion of HR 10 targeting an acoustic frequency of 261 Hz. FIG. 23 is a plot of acoustic transmission loss of the aftertreatment system due to exclusion of HRs 3-10. FIG. 24 is a plot of acoustic transmission loss of the aftertreatment system due to exclusion of the quarter wave (QW) tube targeting an acoustic frequency of 332 Hz.

Figure 25:
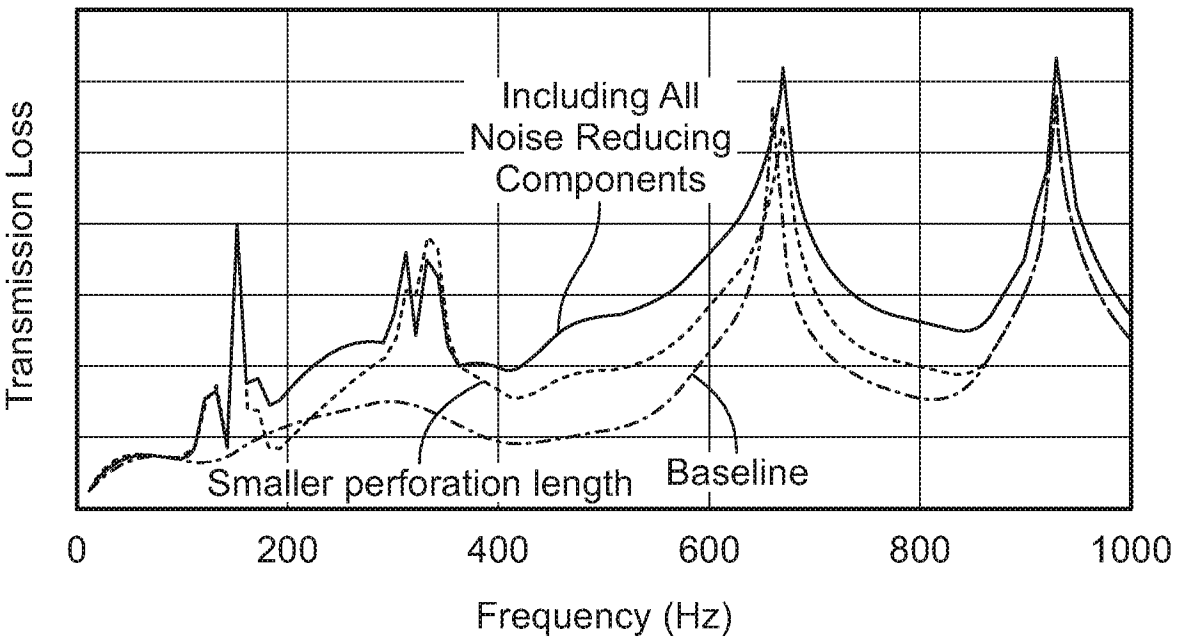
FIG. 25 shows plots of noise transmission loss of the aftertreatment system of claim FIG. 11, the base line aftertreatment system and the aftertreatment system of FIG. 11 including a smaller perforated tube.

FIG. 25 is a plot of acoustic transmission loss of the aftertreatment system of FIG. 11 relative to the baseline aftertreatment system and a modified aftertreatment system of FIG. 11 in which a length of a portion of the perforated tube including which includes the perforations is reduced by about 68%. This leads to a significant loss in acoustic transmission loss as shown in FIG. 25. Thus various noise components may be included in or excluded from the aftertreatment system, or a size of noise reducing components may be adjusted to target particular noise frequencies in the aftertreatment system.

Figure 26:
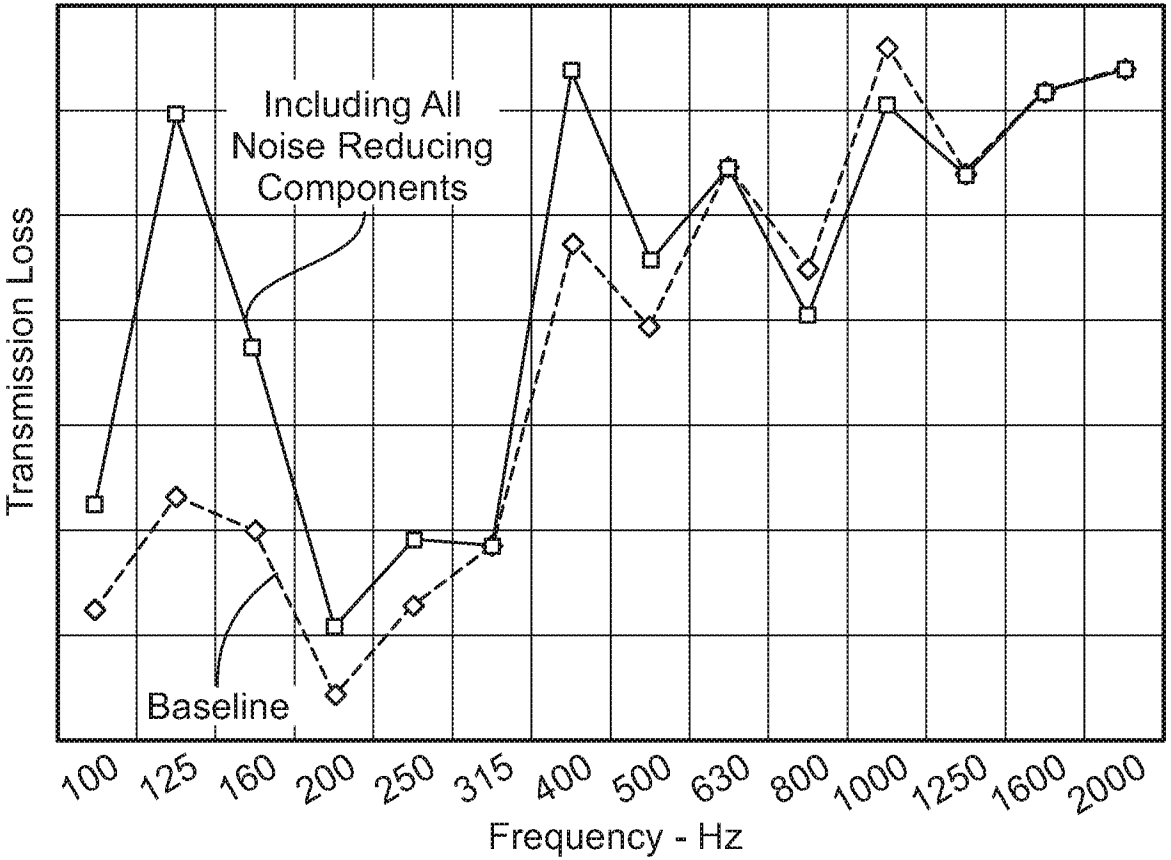
FIG. 26 shows plots of noise transmission loss of the aftertreatment system of FIGS. 10A-10C, and a base line aftertreatment system that is similar to the aftertreatment system of FIGS. 10A-10C but does not include any noise reducing component.

Experimental tests were also performed on the aftertreatment system of FIGS. 10A-10C on a test rig at a temperature of 20 degrees Celsius. FIG. 26 show plots of acoustic or sound loss transmission of the aftertreatment system of FIGS. 10A-10C relative to a baseline aftertreatment system that is similar to the aftertreatment system of FIGS. 10A-10AC but does not include any noise reducing components. Substantial improvement in acoustic transmission loss is observed below acoustic frequencies of 630 Hz.

As utilized herein, the terms "substantially' and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise arrangements and/or numerical ranges provided. Accordingly, these terms should be interpreted as indicating that insubstantial or inconsequential modifications or alterations of the subject matter described and claimed are considered to be within the scope of the inventions as recited in the appended claims.

As used herein, the term "about" generally mean plus or minus 10% of the stated value. For example, about 0.5 would include 0.45 and 0.55, about 10 would include 9 to 11, about 1000 would include 900 to 1100.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements; values of parameters, mounting arrangements; use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes, and omissions may also be made in the design, operating conditions, and arrangement of the various exemplary embodiments without departing from the scope of the present application.

While this specification contains many specific implementation details, these should not be construed as limitations on the scope of any embodiments or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An apparatus, comprising:

a housing defining an internal volume and structured to house an aftertreatment component for reducing constituents of an exhaust gas; and a noise reducing component disposed within the internal volume and structured to extend around an outer periphery of at least a portion of the aftertreatment component, the noise reducing component comprising a first Helmholtz resonator that comprises:

a container defining a first Helmholtz resonator internal volume, a channel defined through the container and structured to allow the aftertreatment component to be inserted therethrough, a plurality of walls separating the first Helmholtz resonator internal volume into a plurality of portions, and a plurality of first Helmholtz resonator inlet tubes structured to allow a portion of the exhaust gas to enter the first Helmholtz resonator internal volume, each first Helmholtz resonator inlet tube corresponding to one of the plurality of portions.

2. The apparatus of claim 1, further comprising an upstream Helmholtz resonator positioned upstream of a location configured to house the aftertreatment component.

3. The apparatus of claim 2, wherein the housing includes an inlet structured to receive the exhaust gas, and wherein the upstream Helmholtz resonator comprises:

a flow directing wall configured to direct exhaust gas flow from the inlet towards the aftertreatment component, the flow directing wall having a first end positioned proximate to the inlet and coupled to a first side wall of the housing that defines the inlet, and a second end coupled to a second sidewall of the housing distal from the inlet such that the flow directing wall, the first side wall and the second sidewall collectively define an upstream Helmholtz resonator internal volume; and at least one upstream Helmholtz resonator inlet tube positioned through the flow directing wall for allowing a portion of the exhaust gas to enter the upstream Helmholtz resonator internal volume.

4. The apparatus of claim 3, wherein the at least one upstream Helmholtz resonator inlet tube comprises a first upstream Helmholtz resonator inlet tube disposed through the flow directing wall proximate to the inlet.

5. The apparatus of claim 4, wherein the at least one upstream Helmholtz resonator inlet tube comprises a second upstream Helmholtz resonator inlet tube disposed through the flow directing wall proximate to the second sidewall of the housing.

6. The apparatus of claim 1, further comprising a perforated tube disposed downstream of a location configured to house the aftertreatment component through an endwall of the housing, the perforated tube having a first portion located within the internal volume of the housing and a second portion located outside the internal volume so as to form an outlet of the housing, the first portion defining a plurality of perforations.

7. The apparatus of claim 6, further comprising a quarter wave tube positioned within the internal volume of the housing downstream of the location configured to house the aftertreatment component, a first end of the quarter wave tube positioned proximate to the first portion of the perforated tube and structured to receive a portion of the exhaust gas via the plurality of perforations, and a second end of the quarter wave tube positioned distal from the perforated tube and fluidly sealed from the internal volume.

8. An aftertreatment system for reducing constituents of an exhaust gas produced by an engine, comprising:

a housing defining an internal volume;

an aftertreatment component positioned within the internal volume; and a noise reducing component positioned within the internal volume and extending around an outer periphery of at least a portion of the aftertreatment component, the noise reducing component comprising a first Helmholtz resonator that comprises:

a container defining a first Helmholtz resonator internal volume, a channel defined through the container and structured to allow the aftertreatment component to be inserted therethrough, the first Helmholtz resonator defining at least one first Helmholtz resonator inlet tube structured to allow a portion of the exhaust gas to enter the first Helmholtz resonator internal volume, a plurality of walls separating the first Helmholtz resonator internal volume into a plurality of portions, and a plurality of first Helmholtz resonator inlet tubes, each corresponding to one of the plurality of portions.

9. The aftertreatment system of claim 8, wherein the aftertreatment system comprises a plurality of aftertreatment components and a plurality of first Helmholtz resonators, each of the plurality of first Helmholtz resonators extending around a corresponding aftertreatment component of the plurality of aftertreatment components.

10. The aftertreatment system of claim 8, further comprising an upstream Helmholtz resonator positioned upstream of the aftertreatment component.

11. The aftertreatment system of claim 10, wherein the housing includes an inlet structured to receive the exhaust gas, and wherein the upstream Helmholtz resonator comprises:

a flow directing wall configured to direct exhaust gas flow from the inlet towards the aftertreatment component, the flow directing wall having a first end positioned proximate to the inlet and coupled to a first side wall of the housing that defines the inlet, and a second end coupled to a second sidewall of the housing distal from the inlet such that the flow directing wall, the first side wall and the second sidewall collectively define an upstream Helmholtz resonator internal volume; and at least one upstream Helmholtz resonator inlet tube positioned through the flow directing wall for allowing a portion of the exhaust gas to enter the upstream Helmholtz resonator internal volume.

12. The aftertreatment system of claim 11, wherein the at least one upstream Helmholtz resonator inlet tube comprises a first upstream Helmholtz resonator inlet tube disposed through the flow directing wall proximate to the inlet.

13. The aftertreatment system of claim 12, wherein the at least one upstream Helmholtz resonator inlet tube comprises a second upstream Helmholtz resonator inlet tube disposed through the flow directing wall proximate to the second sidewall of the housing.

14. The aftertreatment system of claim 8, further comprising a perforated tube disposed downstream of the aftertreatment component through an endwall of the housing, the perforated tube having a first portion located within the internal volume of the housing and the second portion located outside the internal volume so as to form an outlet of the aftertreatment system, the first portion defining a plurality of perforations.

15. The aftertreatment system of claim 14, further comprising a quarter wave tube positioned within the internal volume of the housing downstream of the aftertreatment component, a first end of the quarter wave tube positioned proximate to the first portion of the perforated tube and structured to receive a portion of the exhaust gas via the plurality of perforations, and a second end of the quarter wave tube positioned distal from the perforated tube and fluidly sealed from the internal volume.

16. An aftertreatment system for decomposing constituents of an exhaust gas produced by an engine, the aftertreatment system comprising:

an aftertreatment module comprising:

an aftertreatment module housing comprising an inlet for receiving the exhaust gas, an aftertreatment module housing outer surface extending around a longitudinal axis of the aftertreatment system, and an aftertreatment component positioned within the aftertreatment module housing; and a noise reduction module located at an end of the aftertreatment module, the noise reduction module being distinct from the aftertreatment module and coupled to the aftertreatment module, the noise reduction module being configured to receive treated exhaust gas from the aftertreatment module and comprising:

a noise reduction module housing directly coupled to the aftertreatment module housing, the noise reduction module housing comprising an outlet for expelling treated exhaust gas, a noise reduction module housing outer surface extending around the longitudinal axis of the aftertreatment system, and a noise reduction component disposed within the noise reduction module housing;

wherein an outermost extent of the noise reduction module housing outer surface in a direction perpendicular to the longitudinal axis of the aftertreatment system is located at or inward of an innermost extent of the aftertreatment module housing outer surface in the direction perpendicular to the longitudinal axis.

17. The aftertreatment system of claim 16, wherein the noise reduction module housing outer surface is continuous with the aftertreatment module housing outer surface in a longitudinal direction of the aftertreatment system.

18. The aftertreatment system of claim 17, wherein a cross-sectional shape of the noise reduction module housing in a plane perpendicular to the longitudinal axis of the aftertreatment system is the same as a cross-sectional shape of the aftertreatment module housing in a plane perpendicular to the longitudinal axis of the aftertreatment system.

19. The aftertreatment system of claim 16, wherein the inlet and the outlet are oriented parallel to the longitudinal axis of the aftertreatment system.

20. The aftertreatment system of claim 16, wherein the inlet and the outlet are axially aligned in a longitudinal direction of the aftertreatment system.

21. The aftertreatment system of claim 16, wherein the inlet is oriented parallel to the longitudinal axis of the aftertreatment system, and the outlet is oriented perpendicular to the longitudinal axis of the aftertreatment system.

22. An apparatus, comprising:

a housing defining an internal volume and structured to house an aftertreatment component for reducing constituents of an exhaust gas; and a noise reducing component disposed within the internal volume and structured to extend around an outer periphery of at least a portion of the aftertreatment component, the noise reducing component comprising an upstream Helmholtz resonator positioned upstream of a location configured to house the aftertreatment component, wherein the housing includes an inlet structured to receive the exhaust gas, and wherein the upstream Helmholtz resonator comprises:

a flow directing wall configured to direct exhaust gas flow from the inlet towards the aftertreatment component, the flow directing wall having a first end positioned proximate to the inlet and coupled to a first side wall of the housing that defines the inlet, and a second end coupled to a second sidewall of the housing distal from the inlet such that the flow directing wall, the first side wall and the second sidewall collectively define an upstream Helmholtz resonator internal volume; and at least one upstream Helmholtz resonator inlet tube positioned through the flow directing wall for allowing a portion of the exhaust gas to enter the upstream Helmholtz resonator internal volume.

23. An apparatus, comprising:

a housing defining an internal volume and structured to house an aftertreatment component for reducing constituents of an exhaust gas; and a noise reducing component disposed within the internal volume and structured to extend around an outer periphery of at least a portion of the aftertreatment component, the noise reducing component comprising a perforated tube disposed downstream of a location configured to house the aftertreatment component through an endwall of the housing, the perforated tube having a first portion located within the internal volume of the housing and a second portion located outside the internal volume so as to form an outlet of the housing, the first portion defining a plurality of perforations.

24. An aftertreatment system for reducing constituents of an exhaust gas produced by an engine, comprising:

a housing defining an internal volume;

an aftertreatment component positioned within the internal volume; and a noise reducing component positioned within the internal volume and extending around an outer periphery of at least a portion of the aftertreatment component, the noise reducing component comprising an upstream Helmholtz resonator positioned upstream of the aftertreatment component, wherein the housing includes an inlet structured to receive the exhaust gas, and wherein the upstream Helmholtz resonator comprises:

a flow directing wall configured to direct exhaust gas flow from the inlet towards the aftertreatment component, the flow directing wall having a first end positioned proximate to the inlet and coupled to a first side wall of the housing that defines the inlet, and a second end coupled to a second sidewall of the housing distal from the inlet such that the flow directing wall, the first side wall and the second sidewall collectively define an upstream Helmholtz resonator internal volume; and at least one upstream Helmholtz resonator inlet tube positioned through the flow directing wall for allowing a portion of the exhaust gas to enter the upstream Helmholtz resonator internal volume.

25. An aftertreatment system for reducing constituents of an exhaust gas produced by an engine, comprising:

a housing defining an internal volume;

an aftertreatment component positioned within the internal volume; and a noise reducing component positioned within the internal volume and extending around an outer periphery of at least a portion of the aftertreatment component, the noise reducing component comprising a perforated tube disposed downstream of the aftertreatment component through an endwall of the housing, the perforated tube having a first portion located within the internal volume of the housing and the second portion located outside the internal volume so as to form an outlet of the aftertreatment system, the first portion defining a plurality of perforations.

* * * * *